US012560353B2

(12) United States Patent
Brisebois

(10) Patent No.: US 12,560,353 B2
(45) Date of Patent: Feb. 24, 2026

(54) DAMPER HAVING A PLURALITY OF BLADE ASSEMBLIES

(71) Applicant: AIREAU QUALITE CONTROLE INC., Bois-des-Filion (CA)

(72) Inventor: Martin Brisebois, St-Apollinaire (CA)

(73) Assignee: AIREAU QUALITÉ CONTRÔLE INC., Bois-des-Filion (CA)

( * ) Notice: Subject to any disclaimer, the term of this patent is extended or adjusted under 35 U.S.C. 154(b) by 451 days.

(21) Appl. No.: 17/797,543

(22) PCT Filed: Feb. 5, 2021

(86) PCT No.: PCT/IB2021/050969

§ 371 (c)(1),
(2) Date: Aug. 4, 2022

(87) PCT Pub. No.: WO2021/156827

PCT Pub. Date: Aug. 12, 2021

(65) Prior Publication Data

US 2023/0074548 A1 Mar. 9, 2023

Related U.S. Application Data

(60) Provisional application No. 62/970,442, filed on Feb. 5, 2020.

(51) Int. Cl.
*F24F 13/15* (2006.01)
*F24F 13/14* (2006.01)
*F24F 13/16* (2006.01)

(52) U.S. Cl.
CPC ..... *F24F 13/15* (2013.01); *F24F 13/1406* (2013.01); *F24F 2013/1473* (2013.01)

(58) Field of Classification Search
CPC ..... F24F 13/1406; F24F 13/15; F24F 13/16
See application file for complete search history.

(56) References Cited

U.S. PATENT DOCUMENTS 2,997,939 A * 8/1961 Snyder ..... F24F 13/15 454/319
3,381,601 A * 5/1968 Mccabe ..... F24F 13/15 49/90.1

(Continued)

FOREIGN PATENT DOCUMENTS

GB 2203530 A * 10/1988 ..... F24F 13/15
KR 101832325 B1 2/2018

OTHER PUBLICATIONS

International Search report for PCT/IB2021/050969; Branka Ristovski; Oct. 15, 2021.

(Continued)

*Primary Examiner* — Steven S Anderson, II
(74) *Attorney, Agent, or Firm* — BCE LLP

(57) ABSTRACT

A damper includes first and second blade assemblies disposed next to one another and rotatably supported by a frame to rotate together between open and closed positions. Each of the first and second blade assemblies includes a shaft and first and second blades connected to the shaft. The first and second blade assemblies have respective first and second seal members connected to the blades thereof. In the closed position, the first seal member abuts the second blade assembly at a first contact point to form a first seal, and the second seal member abuts the second blade assembly at a second contact point to form a second seal. The first contact point is further from a blade rotation axis of the first blade assembly than the second contact point. The second contact point is further from a blade rotation axis of the second blade assembly than the first contact point.

24 Claims, 23 Drawing Sheets

(56) References Cited

U.S. PATENT DOCUMENTS

| | | | | | |
|---|---|---|---|---|---|
| 3,620,242 | A | | 11/1971 | Pease | |
| 3,666,236 | A | | 5/1972 | Gachot | |
| 3,783,768 | A | * | 1/1974 | Caming | F24F 13/15 454/335 |
| 4,241,539 | A | * | 12/1980 | Josephson | E06B 7/086 49/77.1 |
| 4,887,641 | A | * | 12/1989 | Alley | F24F 13/15 251/118 |
| 2014/0008561 | A1 | * | 1/2014 | Enke | F24F 13/1413 251/306 |
| 2016/0216000 | A1 | * | 7/2016 | Monahan | F24F 13/1413 |

OTHER PUBLICATIONS

English abstract for KR101832325 retrieved from Espacenet on Oct. 18, 2021.

* cited by examiner

DAMPER HAVING A PLURALITY OF BLADE ASSEMBLIES

CROSS-REFERENCE

The present application claims priority from U.S. Provisional Patent Application No. 62/970,442, filed Feb. 5, 2020, the entirety of which is incorporated herein by reference.

FIELD OF TECHNOLOGY

The present technology relates to dampers having blade assemblies.

BACKGROUND

Dampers are used to control air flow inside of a conduit such as an air duct. Notably, a damper is provided with blades that can open or close to control the air flow through the damper. For instance, if it is desired to block air flow through the damper, the blades thereof are placed in the closed position to restrict air flow through the damper.

However, in practice, the damper can be subject to various leaks as a result of misaligned components thereof. For instance, adjacent blades may not be fully in contact with one another to properly block air flow through the damper in the closed position of the blades. This can be especially problematic in situations where the blades are placed in the closed position to stop the propagation of smoke or other undesirable substance through the air duct.

In view of the foregoing, there is a need for a damper that addresses at least some of these drawbacks.

SUMMARY

It is an object of the present technology to ameliorate at least some of the inconveniences present in the prior art.

According to an aspect of the present technology, there is provided a damper. The damper includes: a frame; at least one first blade assembly and at least one second blade assembly disposed next to one another and rotatably supported by the frame, the at least one first blade assembly and the at least one second blade assembly being rotatable together about respective blade rotation axes between an open position and a closed position, each of the at least one first blade assembly and each of the at least one second blade assembly having a first end portion and a second end portion. When the at least one first blade assembly and the at least one second blade assembly are in the open position: the at least one first blade assembly and the at least one second blade assembly being spaced apart to permit gas flow through the damper, the first end portion of the at least one first blade assembly and the first end portion of the at least one second blade assembly are on a first side of the blade rotation axes, and the second end portion of the at least one first blade assembly and the second end portion of the at least one second blade assembly are on a second side of the blade rotation axes. When the at least one first blade assembly and the at least one second blade assembly are in the closed position, the first end portion of the at least one first blade assembly being in contact with the second end portion of the at least one second blade assembly to restrict gas flow through the damper. Each of the at least one first blade assembly and each of the at least one second blade assembly includes: a shaft rotatably supported by the frame, the shaft defining the blade rotation axis of the blade assembly; a first blade connected to the shaft; and a second blade connected to the shaft, the shaft being disposed between the first and second blades, the first and second blades being connected to one another at the first and second end portions of the blade. The at least one first blade assembly also includes a first seal member disposed at the first end portion of the at least one first blade assembly, the first seal member being connected to the first and second blades of the at least one first blade assembly. The at least one second blade assembly also includes a second seal member disposed at the second end portion of the at least one second blade assembly, the second seal member being connected to the first and second blades of the at least one second blade assembly. In the closed position of the at least one first blade assembly and the at least one second blade assembly: the first seal member abuts the second end portion of the at least one second blade assembly at a first contact point to form a first seal between the at least one first blade assembly and the at least one second blade assembly; the second seal member of the at least one second blade assembly abuts the first end portion of the at least one second blade assembly at a second contact point to form a second seal between the at least one first blade assembly and the at least one second blade assembly; the first contact point is further from the blade rotation axis of the at least one first blade assembly than the second contact point; the second contact point us further from the blade rotation axis of the at least one second blade assembly than the first contact point.

In some embodiments, the first seal member is held between and connected to the first and second blades of the at least one first blade assembly; and the second seal member is held between and connected to the first and second blades of the at least one second blade assembly.

In some embodiments, in the closed position of the at least one first blade assembly and the at least one second blade assembly, the first and second seal members are disposed at least in part and are compressed between the first end portion of the at least one first blade and the second end portion of the at least one second blade assembly.

In some embodiments, the first and second seal members are made of silicone.

In some embodiments, the first and second seal members are made of fiber glass.

In some embodiments, at least one of the first and second seal members has a generally P-shaped or D-shaped cross-sectional profile.

In some embodiments, each of the first and second seal members has a generally P-shaped or D-shaped cross-sectional profile including a rounded contact portion; and in the closed position of the at least one first blade assembly and the at least one second blade assembly: the rounded contact portion of the first seal member of the at least one first blade assembly abuts the second end portion of the at least one second blade assembly; and the rounded contact portion of the second seal member of the at least one second blade assembly abuts the first end portion of the at least one first blade assembly.

In some embodiments, the rounded contact portion of each of the first and second seal members comprises a plurality of projections protruding therefrom.

In some embodiments, the projections have a generally triangular cross-sectional profile.

In some embodiments, for each of the at least one first blade assembly and each of the at least one second blade assembly: the shaft comprises a first flat surface and a second flat surface opposite the first flat surface, the second flat surface extending parallel to the first flat surface; the first blade is fastened to the first flat surface of the shaft; and the second blade is fastened to the second flat surface of the shaft.

In some embodiments, for each of the at least one first blade assembly and each of the at least one second blade assembly, the shaft comprises a generally rectangular cuboid portion having a cross-sectional profile that is generally square, the rectangular cuboid portion defining the first and second flat surfaces.

In some embodiments, for each of the at least one first blade assembly and each of the at least one second blade assembly, the shaft further comprises a first cylindrical portion and a second cylindrical portion, the first and second cylindrical portions extending on opposite sides of the rectangular cuboid portion of the shaft.

In some embodiments, the damper also includes a blade rotation system for rotating each of the at least one first blade assembly and each of the at least one second blade assembly between the open and closed positions. For each of the at least one first blade assembly and each of the at least one second blade assembly, the shaft also includes a non-cylindrical portion defining an end of the shaft, the non-cylindrical portion of the shaft being engaged by the blade rotation system to drive rotation of the shaft.

In some embodiments, for each of the at least one first blade assembly and each of the at least one second blade assembly, the first and second cylindrical portions of the shaft are journaled by the frame.

In some embodiments, for each of the at least one first blade assembly and each of the at least one second blade assembly: in a cross-section of the blade assembly taken along a plane normal to the blade rotation axis, the first and second blades form a diamond-like shape.

In some embodiments, for each of the at least one first blade assembly and each of the at least one second blade assembly: the first blade has a first end and a second end; the second blade has a first end and a second end; and a spacing between the first and second blades is greatest at the shaft and smallest at the first and second ends of the first and second blades.

In some embodiments, the at least one first blade assembly also includes: a blade extension disposed at the first end portion of the at least one first blade assembly, the blade extension being held between the first and second blades and extending from the first and second blades, the first seal member being connected to the blade extension, the blade extension being configured to elastically deform upon the first seal member contacting the second end portion of the at least one second blade assembly when the at least one first blade assembly and the at least one second blade assembly are in the closed position.

In some embodiments, for the at least one first blade assembly: the first and second blades are made of a first material; the blade extension is made of a second material; and the second material has a smaller elastic modulus than the first material.

In some embodiments, the second material is stainless steel.

In some embodiments, the at least one first blade assembly has a first end provided at the first end portion and a second end provided at the second end portion; and the first seal member is disposed at the first end of the at least one first blade assembly, the first seal member being connected to an end of the blade extension of the at least one first blade assembly.

In some embodiments, the damper includes a blade rotation system for rotating each of the at least one first blade assembly and each of the at least one second blade assembly between the open and closed positions, the blade rotation system comprising: a linkage assembly including a plurality of shaft links drivingly connected to the shaft of the at least one first blade assembly and the at least one second blade assembly; and an actuator connected to the linkage assembly, the actuator being operable to move the linkage assembly to cause the at least one first blade assembly and the at least one second blade assembly to rotate together from the open position to the closed position and vice-versa.

In some embodiments, the at least one second blade assembly also includes a blade extension disposed at the first end portion of the at least one second blade assembly, the blade extension of the at least one second blade assembly being held between the first and second blades thereof and extending from the first and second blades, the blade extension of the at least one second blade assembly being configured to elastically deform upon the first end portion of the at least one second blade assembly contacting a corresponding structure when the at least one first blade assembly and the at least one second blade assembly are in the closed position.

In some embodiments, the at least one first blade assembly includes a plurality of first blade assemblies; the at least one second blade assembly includes a plurality of second blade assemblies; and the first blade assemblies and the second blade assemblies are arranged alternatingly such that each first blade assembly of the plurality of first blade assemblies is disposed next to at least one of the second blade assemblies.

In some embodiments, the frame comprises two opposite lateral walls and two opposite end walls; the shafts of the at least one first blade assembly and the at least one second blade assembly are rotatably supported by the lateral walls of the frame. The damper also includes: a blade supporting member connected to a given one of the end walls and extending from the given one of the end walls towards the opposite end wall of the frame; and a third blade assembly disposed between one of the at least one second blade assembly and the given one of the end walls of the frames, the third blade assembly being rotatably supported by the frame such that the third blade assembly is rotatable about a corresponding blade rotation axis between the open position and the closed position, the at least one first blade assembly, the at least one second blade assembly and the third blade assembly being rotatable together about the corresponding blade rotation axes between the open position and the closed position, the third blade assembly having a first end portion and a second end portion. When the at least one first blade assembly, the at least one second blade assembly and the third blade assembly are in the open position: the at least one first blade assembly, the at least one second blade assembly and the third blade assembly being spaced apart to permit gas flow through the damper, the first end portion of the at least one first blade assembly, the first end portion of the at least one second blade assembly and the first end portion of the third blade assembly being on a first side of the blade rotation axes, and the second end portion of the at least one first blade assembly, the second end portion of the at least one second blade assembly and the second end portion of the third blade assembly being on a second side of the blade rotation axes. When the at least one first blade assembly, the at least one second blade assembly and the third blade assembly are in the closed position to restrict gas flow through the damper: the first end portion of the at least one first blade assembly is in contact with the second end portion of the at least one second blade assembly; the first end portion of the one of the at least one second blade assembly is in contact with the second end portion of the third blade assembly; and the first end portion of the third blade assembly is in contact with the blade supporting member.

According to another aspect of the present technology, there is provided a damper. The damper includes: a frame; at least one first blade assembly and at least one second blade assembly disposed next to one another and rotatably supported by the frame, the at least one first blade assembly and the at least one second blade assembly being rotatable together about respective blade rotation axes between an open position and a closed position. The at least one first blade assembly has a first end portion and a second end portion. The at least one second blade assembly has a first end portion and a second end portion. When the at least one first blade assembly and the at least one second blade assembly are in the open position: the at least one first blade assembly and the at least one second blade assembly are spaced apart to permit gas flow through the damper, the first end portion of the at least one first blade assembly and the first end portion of the at least one second blade assembly are on a first side of the blade rotation axes, and the second end portion of the at least one first blade assembly and the second end portion of the at least one second blade assembly are on a second side of the blade rotation axes. When the at least one first blade assembly and the at least one second blade assembly are in the closed position, the first end portion of the at least one first blade assembly is in contact with the second end portion of the at least one second blade assembly to restrict gas flow through the damper. The at least one first blade assembly includes: a shaft rotatably supported by the frame, the shaft defining the blade rotation axis of the at least one first blade assembly; a first blade connected to the shaft; a second blade connected to the shaft, the shaft being disposed between the first and second blades, the first and second blades being connected to one another; and a blade extension disposed at the first end portion of the at least one first blade assembly, the blade extension being held between the first and second blades and extending from the first and second blades, the blade extension being configured to elastically deform upon the first end portion contacting the second end portion of the at least one second blade assembly when the at least one first blade assembly and the at least one second blade assembly are in the closed position. The at least one second blade assembly includes: a shaft rotatably supported by the frame, the shaft defining the blade rotation axis of the at least one second blade assembly; a first blade connected to the shaft; and a second blade connected to the shaft, the shaft being disposed between the first and second blades, the first and second blades being connected to one another.

In some embodiments, for each of the at least one first blade assembly and the at least one second blade assembly: the shaft includes a first flat surface and a second flat surface opposite the first flat surface, the second flat surface extending parallel to the first flat surface; the first blade is fastened to the first flat surface of the shaft; and the second blade is fastened to the second flat surface of the shaft.

In some embodiments, for each of the at least one first blade assembly and the at least one second blade assembly, the shaft includes a generally rectangular cuboid portion having a cross-sectional profile that is generally square, the rectangular cuboid portion defining the first and second flat surfaces.

In some embodiments, for each of the at least one first blade assembly and the at least one second blade assembly, the shaft also includes a first cylindrical portion and a second cylindrical portion, the first and second cylindrical portions extending on opposite sides of the rectangular cuboid portion of the shaft.

In some embodiments, the damper includes a blade rotation system for rotating each of the at least one first blade assembly and each of the at least one second blade assembly. For each of the at least one first blade assembly and the at least one second blade assembly, the shaft also includes a non-cylindrical portion defining an end of the shaft, the non-cylindrical portion of the shaft being engaged by the blade rotation system to drive rotation of the shaft.

In some embodiments, for each of the at least one first blade assembly and the at least one second blade assembly, the first and second cylindrical portions of the shaft are journaled by the frame.

In some embodiments, for each of the at least one first blade assembly and the at least one second blade assembly: in a cross-section of the blade assembly taken along a plane normal to the blade rotation axis, the first and second blades form a diamond-like shape.

In some embodiments, for each of the at least one first blade assembly and the at least one second blade assembly: the first blade has a first end and a second end; the second blade has a first end and a second end; and a spacing between the first and second blades is greatest at the shaft and smallest at the first and second ends of the first and second blades.

In some embodiments, for the at least one first blade assembly: the first and second blades are made of a first material; the blade extension is made of a second material; and the second material has a smaller elastic modulus than the first material.

In some embodiments, the second material is stainless steel.

In some embodiments, each of the at least one first blade assembly and the at least one second blade assembly has: a first end provided at the first end portion; and a second end provided at the second end portion. The at least one first blade assembly also includes a seal member disposed at the first end of the at least one first blade assembly, the seal member of the at least one first blade assembly being connected to an end of the blade extension of the at least one first blade assembly. When the at least one first blade assembly and the at least one second blade assembly are in the closed position, the seal member of the at least one first blade assembly abuts the second end portion of the at least one second blade assembly at a first contact point to form a seal between the at least one first blade assembly and the at least one second blade assembly at the first contact point.

In some embodiments, the at least one second blade assembly also includes a seal member disposed at the second end of the at least one second blade assembly. When the at least one first blade assembly and the at least one second blade assembly are in the closed position, the seal member of the at least one second blade assembly abuts the first end portion of the at least one first blade assembly at a second contact point to form an other seal between the at least one first blade assembly and the at least one second blade assembly at the second contact point.

In some embodiments, the seal members of the at least one first blade assembly and the at least one second blade assembly are made of silicone.

In some embodiments, at least one of the seal members of the least one first blade assembly and the at least one second blade assembly has a generally P-shaped cross-sectional profile.

In some embodiments, at least one of the seal members of the least one first blade assembly and the at least one second blade assembly has a generally D-shaped cross-sectional profile.

In some embodiments, each of the seal members of the least one first blade assembly and the at least one second blade assembly has a rounded contact portion; and when the at least one first blade assembly and the at least one second blade assembly are in the closed position: the rounded contact portion of the seal member of the at least one first blade assembly abuts the second end portion of the at least one second blade assembly; and the rounded contact portion of the seal member of the at least one second blade assembly abuts the first end portion of the at least one first blade assembly.

In some embodiments, the rounded contact portion of each of the seal members of the at least one first blade assembly and the at least one second blade assembly includes a plurality of projections protruding therefrom.

In some embodiments, the projections have a generally triangular cross-sectional profile.

In some embodiments, the damper includes a blade rotation system for rotating each of the at least one first blade assembly and each of the at least one second blade assembly. The blade rotation system includes: a linkage assembly including a plurality of shaft links drivingly connected to the shaft of the at least one first blade assembly and the at least one second blade assembly; and an actuator connected to the linkage assembly, the actuator being operable to move the linkage assembly to cause the at least one first blade assembly and the at least one second blade assembly to rotate together from the open position to the closed position and vice-versa.

In some embodiments, the at least one second blade assembly also includes: a blade extension disposed at the first end portion of the at least one second blade assembly, the blade extension of the at least one second blade assembly being held between the first and second blades thereof and extending from the first and second blades, the blade extension of the at least one second blade assembly being configured to elastically deform upon the first end portion of the at least one second blade assembly contacting a corresponding structure when the at least one first blade assembly and the at least one second blade assembly are in the closed position.

In some embodiments, the at least one first blade assembly includes a plurality of first blade assemblies; the at least one second blade assembly includes a plurality of second blade assemblies; and the first blade assemblies and the second blade assemblies are arranged alternatingly such that each first blade assembly of the plurality of first blade assemblies is disposed next to at least one of the second blade assemblies.

In some embodiments, the frame includes two opposite lateral walls and two opposite end walls. The shafts of the at least one first blade assembly and the at least one second blade assembly are rotatably supported by the lateral walls of the frame. The damper also includes: a blade supporting member connected to a given one of the end walls and extending from the given one of the end walls towards the opposite end wall of the frame; and a third blade assembly disposed between one of the at least one second blade assembly and the given one of the end walls of the frames. The third blade assembly is rotatably supported by the frame such that the third blade assembly is rotatable about a corresponding blade rotation axis between the open position and the closed position, the at least one first blade assembly, the at least one second blade assembly and the third blade assembly being rotatable together about the corresponding blade rotation axes between the open position and the closed position, the third blade assembly having a first end portion and a second end portion. When the at least one first blade assembly, the at least one second blade assembly and the third blade assembly are in the open position: the at least one first blade assembly, the at least one second blade assembly and the third blade assembly are spaced apart to permit gas flow through the damper, the first end portion of the at least one first blade assembly, the first end portion of the at least one second blade assembly and the first end portion of the third blade assembly are on a first side of the blade rotation axes, and the second end portion of the at least one first blade assembly, the second end portion of the at least one second blade assembly and the second end portion of the third blade assembly are on a second side of the blade rotation axes. When the at least one first blade assembly, the at least one second blade assembly and the third blade assembly are in the closed position to restrict gas flow through the damper: the first end portion of the at least one first blade assembly is in contact with the second end portion of the at least one second blade assembly; the first end portion of the one of the at least one second blade assembly is in contact with the second end portion of the third blade assembly; and the first end portion of the third blade assembly is in contact with the blade supporting member.

Embodiments of the present technology each have at least one of the above-mentioned objects and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of embodiments of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
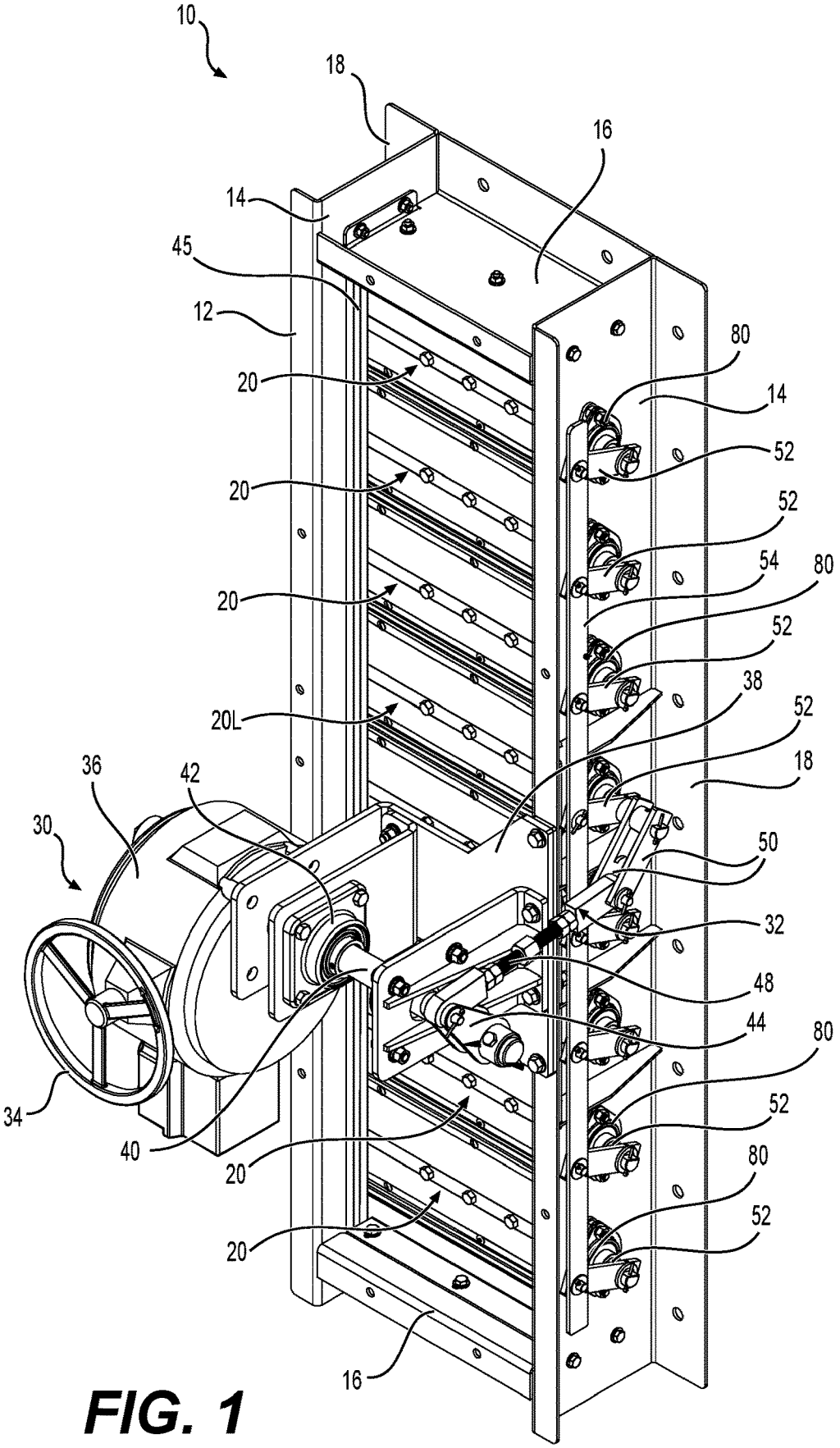
FIG. 1 is a perspective view, taken from a top, front, left side, of a damper in accordance with an embodiment of the present technology, with blade assemblies of the damper being shown in a closed position.
Figure 2:
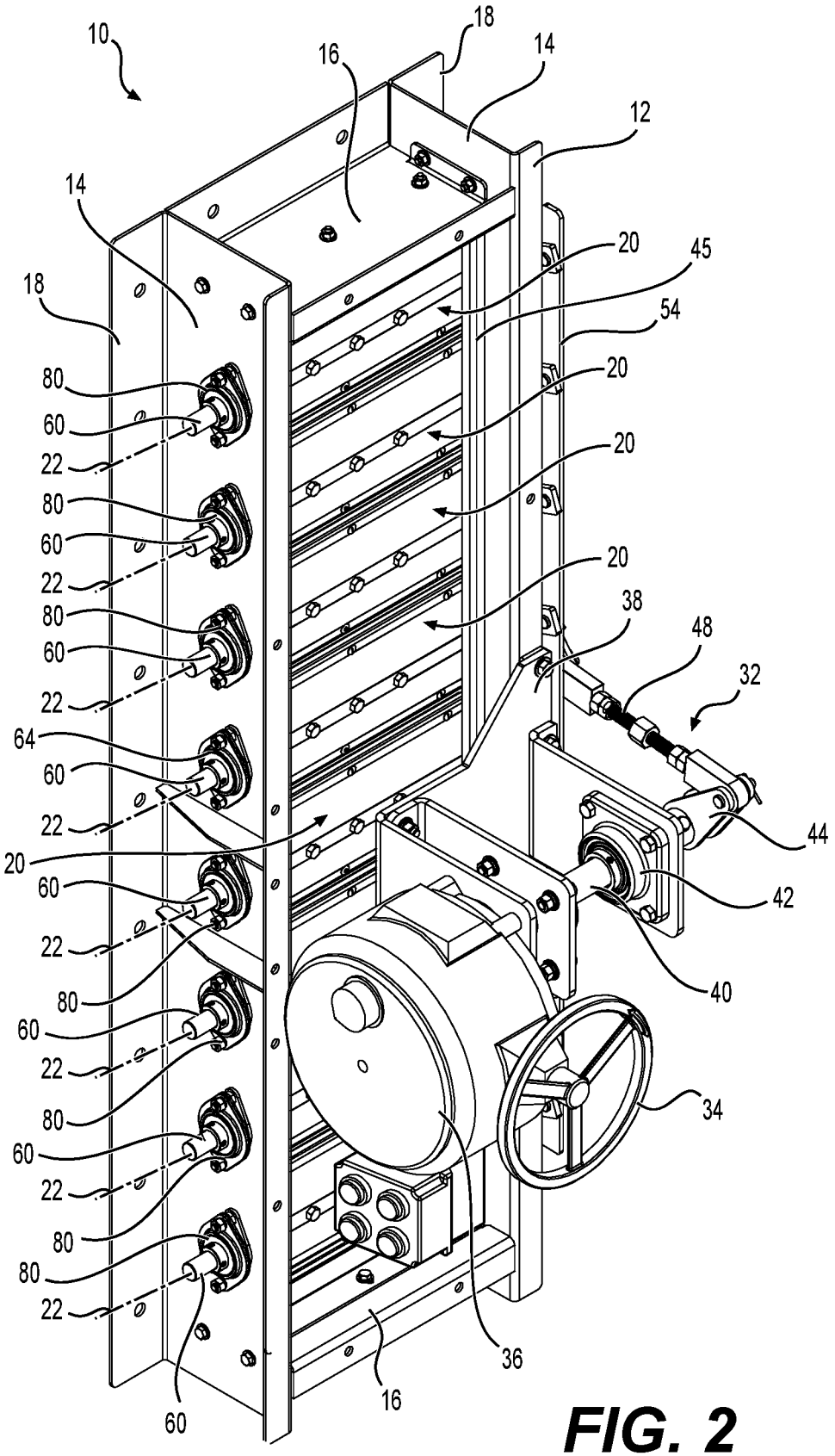
FIG. 2 is a perspective view, taken from a top, front, right side, of the damper of FIG. 1.
Figure 3:
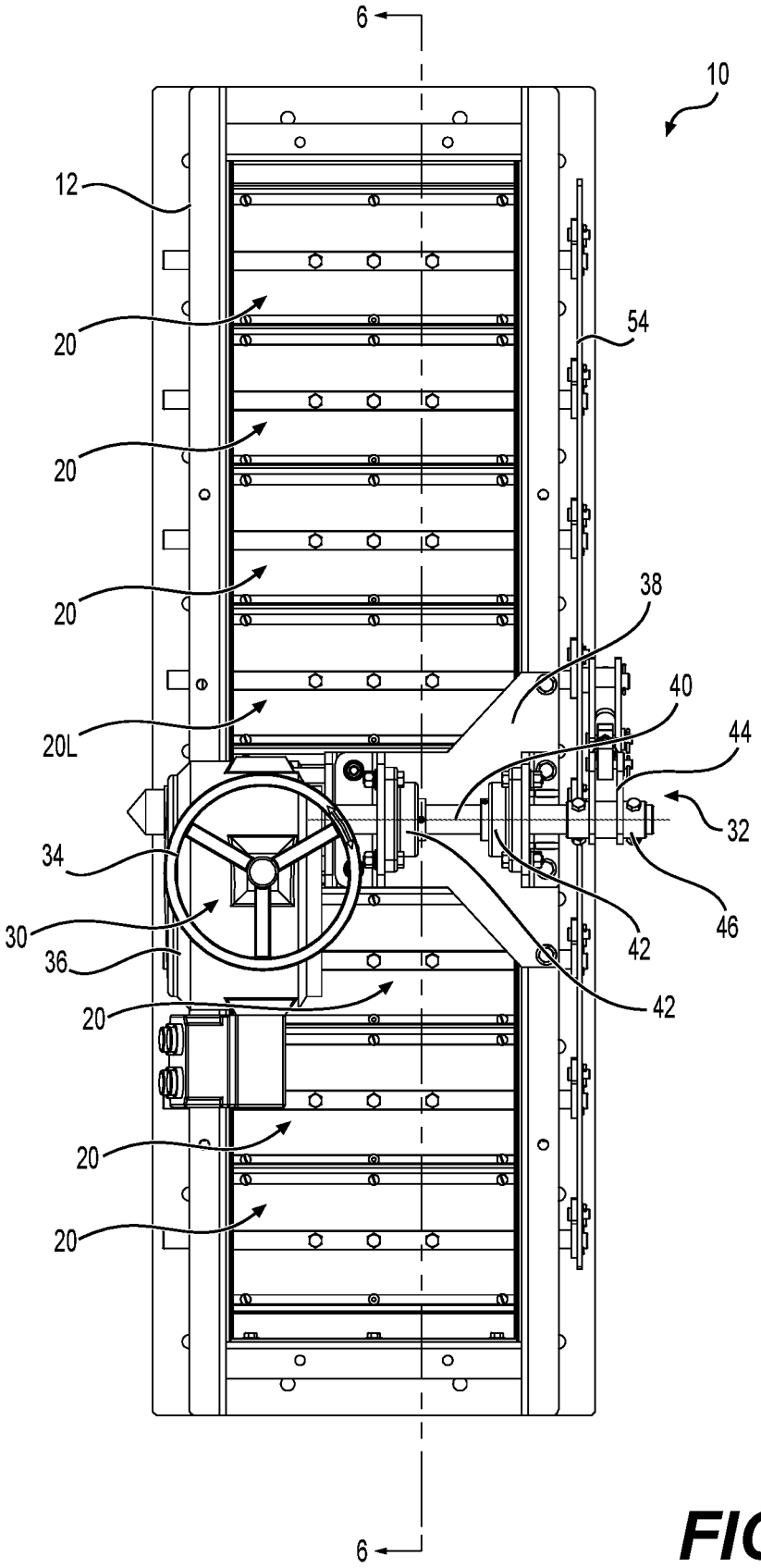
FIG. 3 is a front elevation view of the damper of FIG. 1.

A damper 10 in accordance with one embodiment of the present technology is shown in FIGS. 1 to 5. The damper 10 is configured to be connected to a conduit such as an air duct. While reference is made to an air duct herein, the damper 10 could be connected to a duct through which any gas flows, including gas with suspended particles such as smoke. Moreover, it should be noted that terms referring to the orientation and placement of the damper 10 and its components, such as left, right, top, bottom, vertical, lateral and other similar terms, are used herein to provide a frame of reference to describe the damper 10 as shown in the Figures. However, the damper 10 could be installed in any given orientation.

The damper 10 has a frame 12 configured to be connected to the conduit. As can be seen, the frame 12 is generally rectangular and includes left and right lateral walls 14 and top and bottom walls 16. The lateral walls 14 and the top and bottom walls 16 together define an opening of the frame 12 that is surrounded by the walls 14, 16 and through which air flows through the damper 10. Left and right rear flanges 18 extend laterally outwardly from the left and right lateral walls 14. The flanges 18 are configured to be fastened to the conduit.

The damper 10 also has a plurality of blade assemblies 20 that are disposed one next to the other and are rotatably supported by the frame 12. Notably, the blade assemblies 20 are disposed in the opening defined by the walls 14, 16 of the frame 12. As will be described in greater detail below, the blade assemblies 20 are movable from a closed position (shown in FIGS. 1 to 9) to an open position (shown in FIGS. 10 and 11) and vice-versa to restrict or permit air flow through the damper 10 respectively. In particular, each of the blade assemblies 20 is rotatable between the open position and the closed position about a respective blade rotation axis 22 (FIG. 2) extending laterally.

Figure 6:
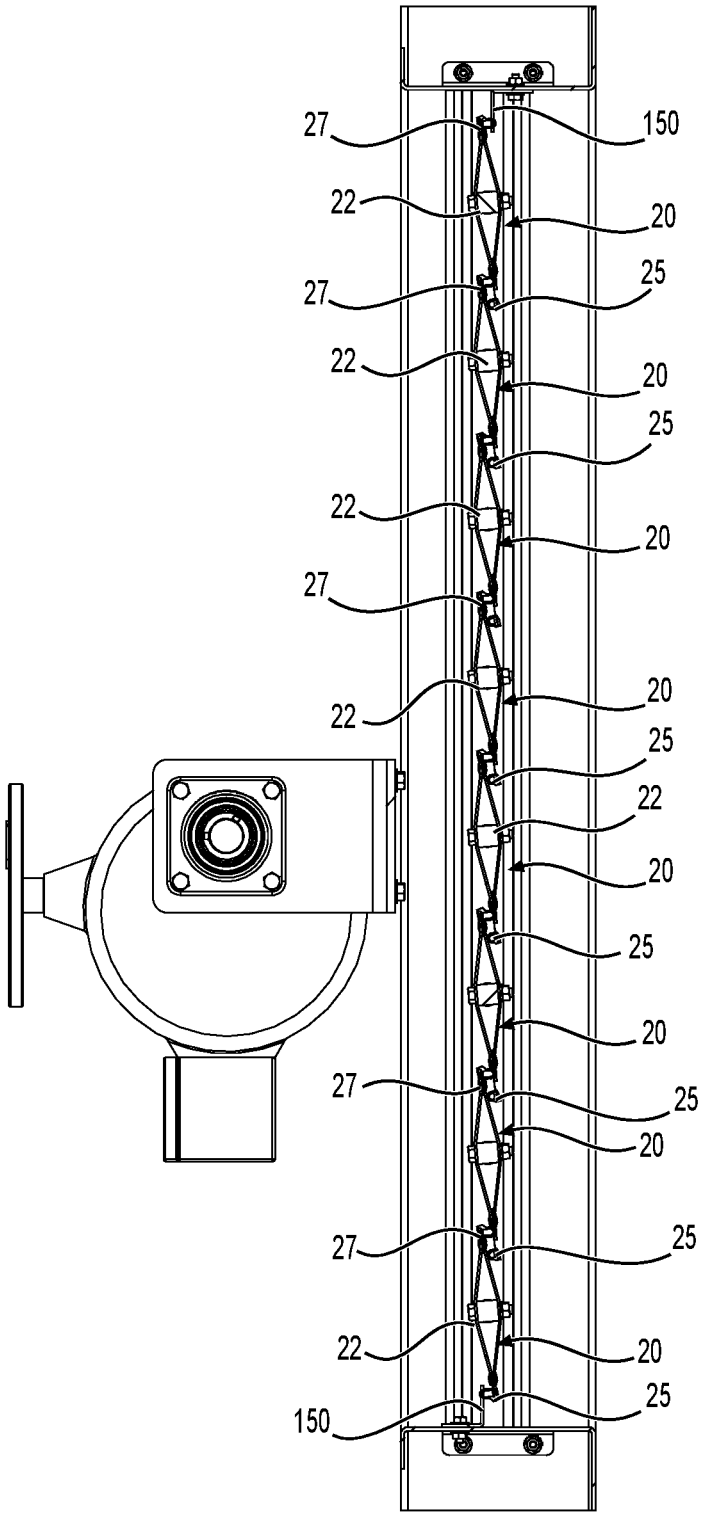
FIG. 6 is a cross-sectional view of the damper of FIG. 1, taken along line 6-6 in FIG. 3.
Figure 11:
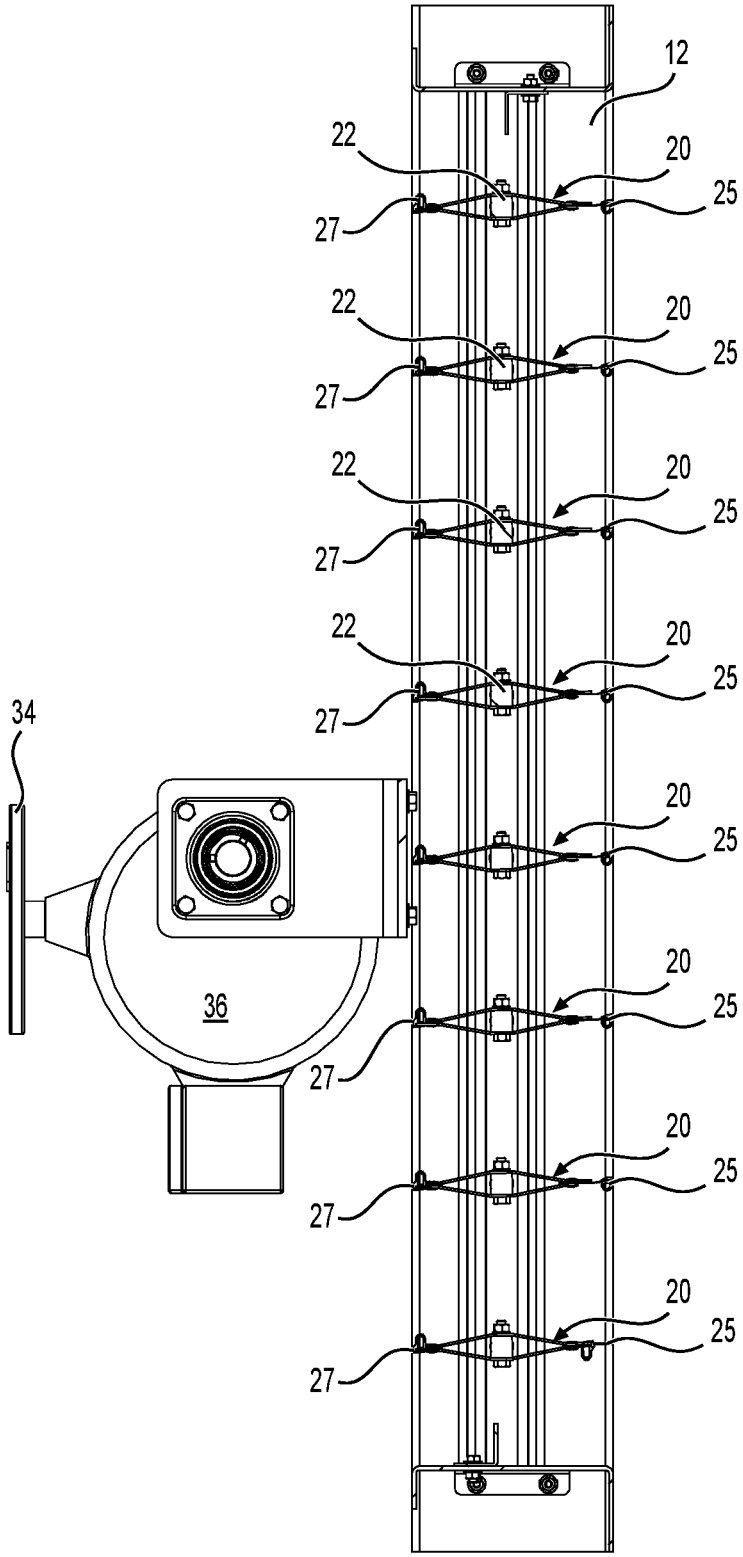
FIG. 11 shows a cross-sectional view of the damper of FIG. 10.

As can be seen in FIGS. 6 and 11, the blade rotation axes 22 of the blade assemblies 20 are aligned with one another such that the blade rotation axes 22 extend within a common plane. When the blade assemblies 20 move from the open position to the closed position, first and second opposite end portions 25, 27 of each of the blade assemblies 20 rotate about the corresponding blade rotation axis 22. As shown in FIG. 11, in the open position of the blade assemblies 20, the first end portions 25 of the blade assemblies 20 are on one side of the blade rotation axes 22 (i.e., on one side of the common plane containing the blade rotation axes 22) while the second end portions 27 of the blade assemblies 20 are on an opposite side of the blade rotation axes 22. As such, when the blade assemblies 20 are in the open position, adjacent ones of the blade assemblies 20 are spaced apart to permit air flow through the damper 10. On the other hand, when the blade assemblies 20 are in the closed position, the first end portion 25 of each of the blade assemblies 20 is in contact either the second end portion 27 of an adjacent blade assembly 20 or a corresponding structure of the damper 10 (as will be explained in greater detail below) so as to restrict air flow through the damper 10. Two vertical sealing members 45 (FIGS. 1, 2) are fastened to the left and right lateral walls 14 respectively to provide a seal between the blade assemblies 20 and the left and right lateral walls 14. In this embodiment, the sealing members 45 are elongated accordion-like members that are fixed at one end and movable by the blade assemblies 20 as the blade assemblies move from the open position to the closed position and vice-versa. In this embodiment, the sealing members 45 are made of stainless steel, specifically SAE 304 stainless steel.

The configuration of the blade assemblies 20 will be described in detail further below.

A blade rotation system 30 is provided for rotating the blade assemblies 20 between the open and closed positions thereof. The blade rotation system 30 includes a linkage assembly 32 including various linking members that are operatively connected to each of the blade assemblies 20 of the damper 10. The blade rotation system 30 also includes an actuator 34 that is operatively connected to the linkage assembly 32 and is operable to move the linkage assembly 32 so as to cause the blade assemblies 20 to rotate from the open position to the closed position and vice-versa. In this embodiment, the actuator 34 is manually operated by a user. In particular, in this embodiment, the actuator 34 is a crank wheel that is operatively connected to the linkage assembly 32 via a gearbox 36. It is contemplated that the actuator 34 may be automatically operated based on a signal received from a controller in communication therewith. For instance, the actuator 34 could be a step motor. Other types of actuators 34 are also contemplated, such as pneumatic and hydraulic actuators.

As can be seen in FIGS. 1 to 5, the actuator 34 and the gearbox 36 are supported by a supporting bracket 38 to which the gearbox 36 is fastened. The supporting bracket 38 is fastened to the frame 12 of the damper 10. The supporting bracket 38 rotatably supports a driving shaft 40 extending laterally from the gearbox 36. In particular, bearings 42 are mounted to the supporting bracket 38 and receive the driving shaft 40 such that the driving shaft 40 is rotatably relative to the supporting bracket 38.

In order to rotate the blade assemblies 20 from the open position to closed position or vice-versa, the user rotates the crank wheel 34 (clockwise or counterclockwise in accordance with the desired position of the blade assemblies 20). This provides an input rotation into the gearbox 36 which in turn outputs a corresponding rotation of the driving shaft 40 according to a predetermined gear ratio of the gearbox 36. The driving shaft 40 is connected at one end thereof to the linkage assembly 32 which is actuated by the rotation of the driving shaft 40.

Figure 4:
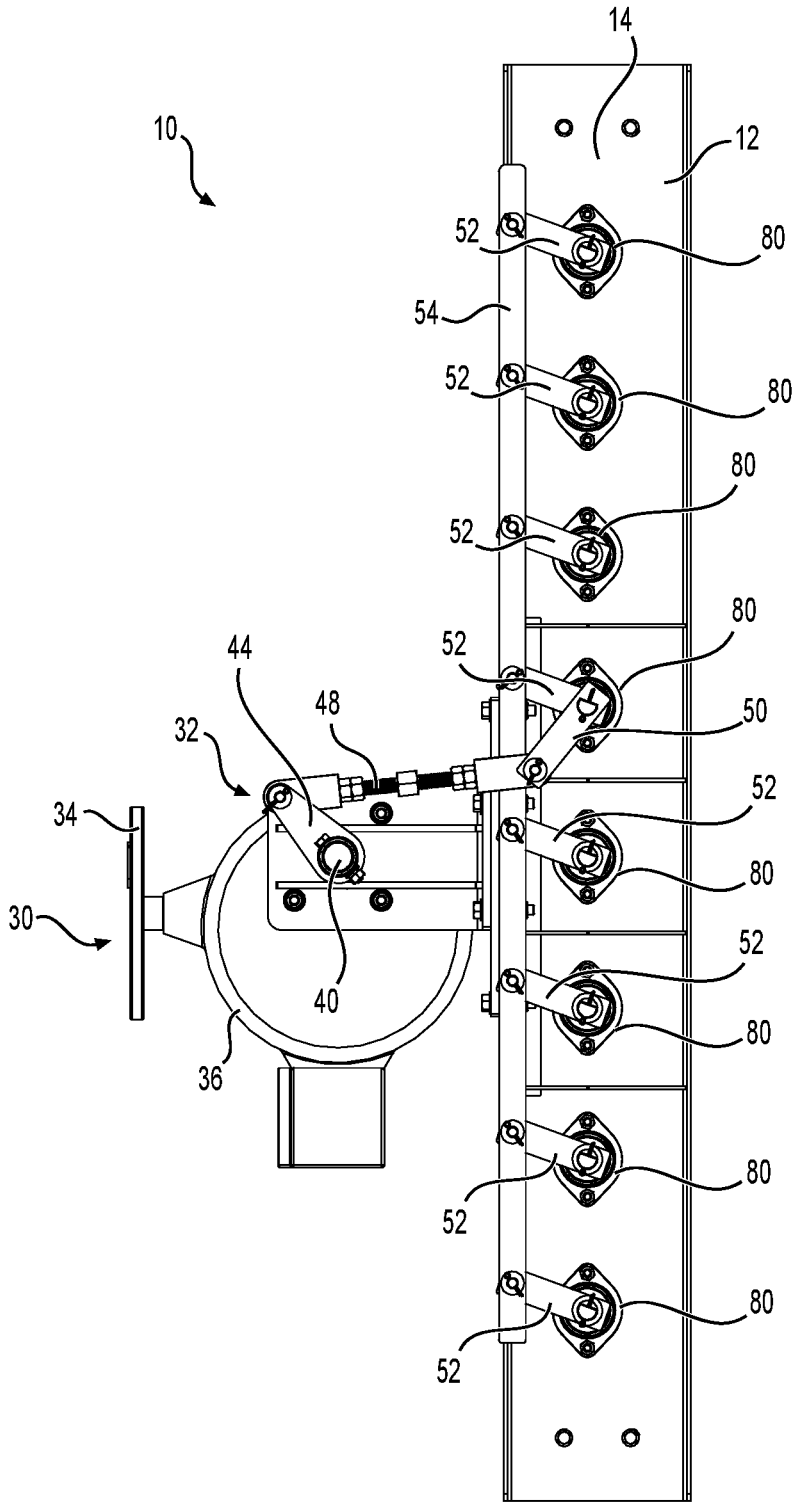
FIG. 4 is a left side elevation view of the damper of FIG. 1.
Figure 5:
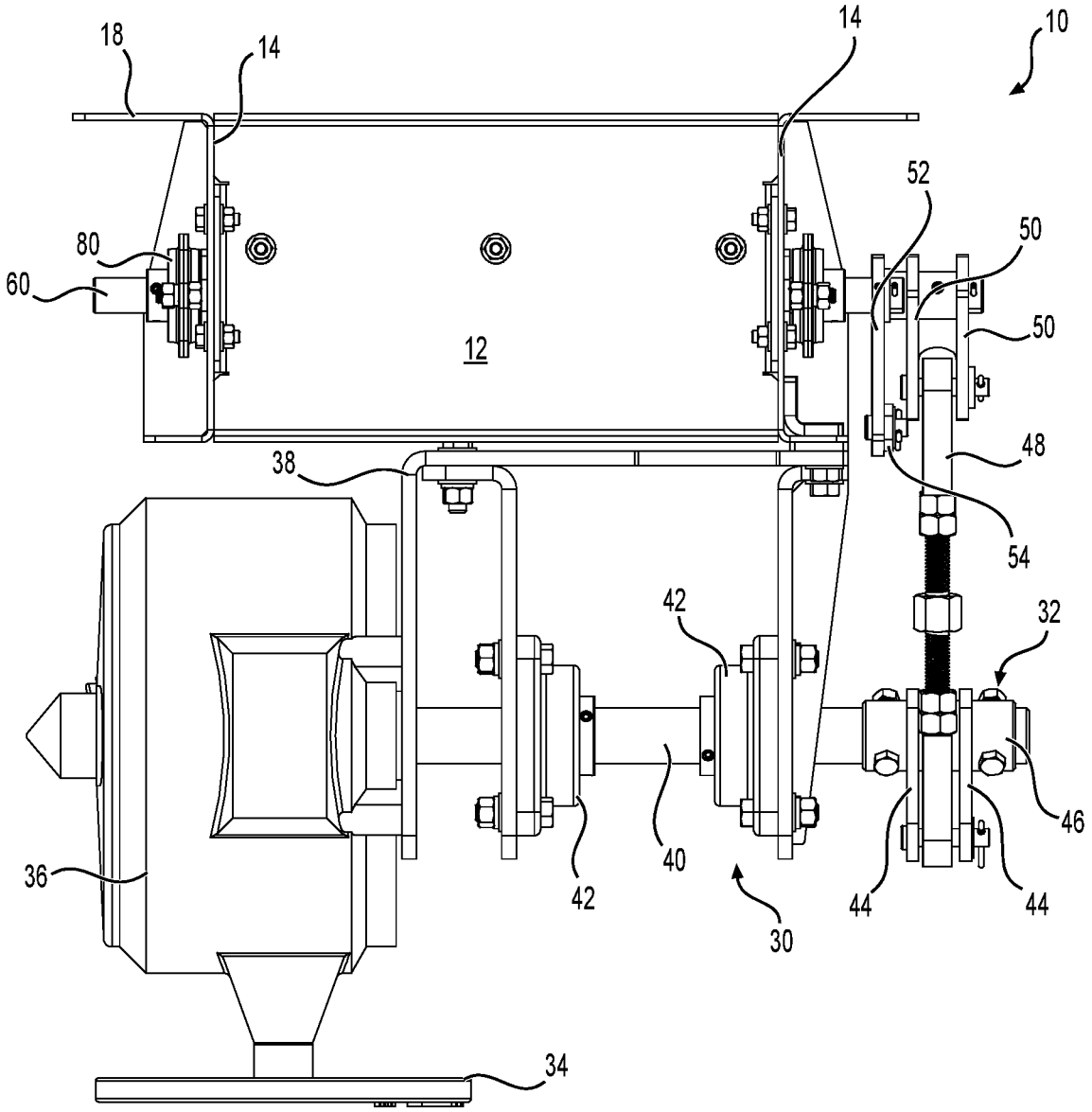
FIG. 5 is a top plan view of the damper of FIG. 1.

As best shown in FIGS. 4 and 5, in this embodiment, the linkage assembly 32 includes two links 44 mounted to a sleeve 46 (FIG. 5) that is fastened to the end of the driving shaft 40 (opposite the end connected to the gearbox 36) so as to rotate therewith. One end of each of the links 44 is mounted to the sleeve 46 to rotate together with the driving shaft 40. The opposite end of each of the links 44 is connected to a tie rod 48 such that an end of the tie rod 48 is received between the links 44. As best shown in FIG. 1, an opposite end of the tie rod 48 is connected to and disposed between a pair of driving links 50 which are connected to a shaft 60 of one of the blade assemblies 20 to drive the rotation of that blade assembly 20. This particular blade assembly 20 may be referred to as a "lead" blade assembly 20L since its rotation also drives the rotation of the other blade assemblies 20 via the linkage assembly 32. Notably, the linkage assembly 32 also includes a plurality of connecting links 52, each connecting link 52 being connected to the shaft 60 of a respective one of the blade assemblies 20 (including the lead blade assembly 20L). Each of the connecting links 52 is also connected to a linking bar 54 that extends vertically and is fastened to an end of each of the connecting links 52. Thus, when the shaft 60 of the lead blade assembly 20L is rotated, the rotary motion is transmitted to the connecting link 52 that is connected to the shaft 60 of the lead blade assembly 20L, and as a result the rotation of the of connecting link 52 results in an up or down translation of the linking bar 54. As every other connecting link 52 is connected to the linking bar 54, the connecting links 52 rotate as a result of the translation of the linking bar 54 and thereby the connecting links 52 transmit the rotary motion to the shafts 60 of the blade assemblies 20.

The blade assemblies 20 will now be described in greater detail with respect to FIGS. 12 to 16. While FIGS. 12 to 16 illustrate the lead blade assembly 20L, as will be discussed further below, the lead blade assembly 20L is almost identical to the other blade assemblies 20 and therefore most aspects of the construction of the lead blade assembly 20L apply to the other blade assemblies 20. The differences between the lead blade assembly 20L and the other blade assemblies 20 will be described in detail below.

Figure 13:
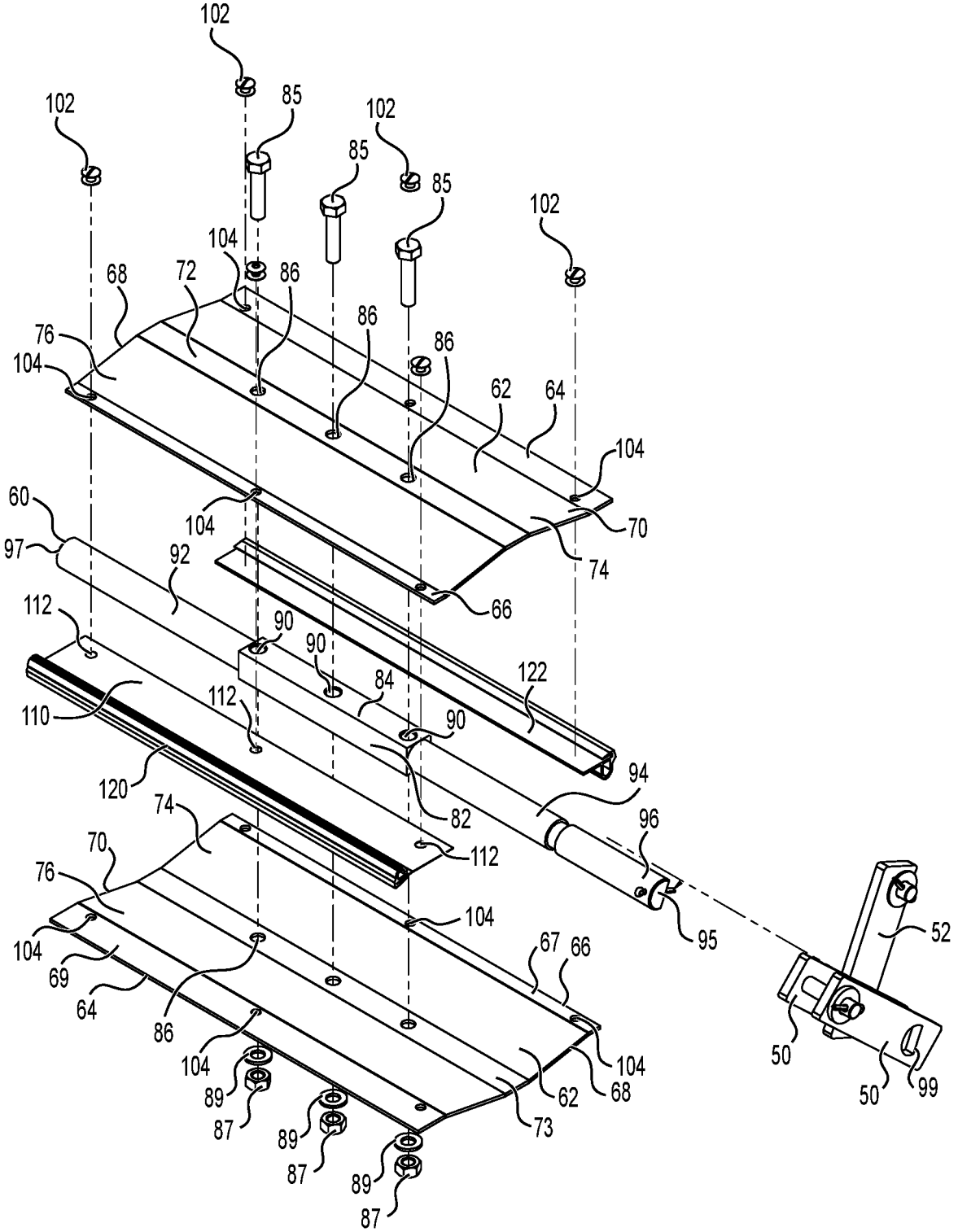
FIG. 13 is an exploded view of the lead blade assembly of FIG. 12.
Figure 14:
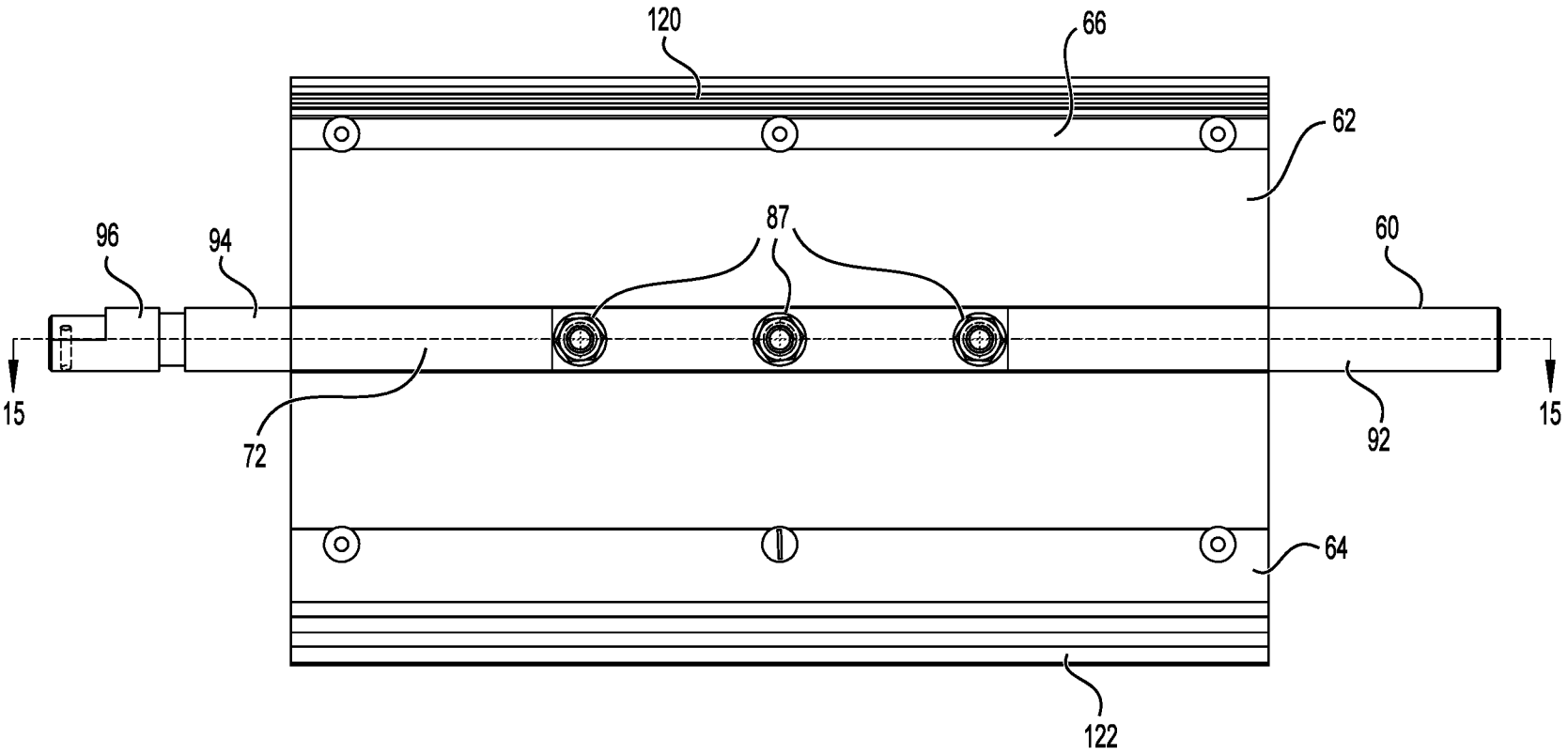
FIG. 14 is a top plan view of the lead blade assembly of FIG. 12.
Figure 15:
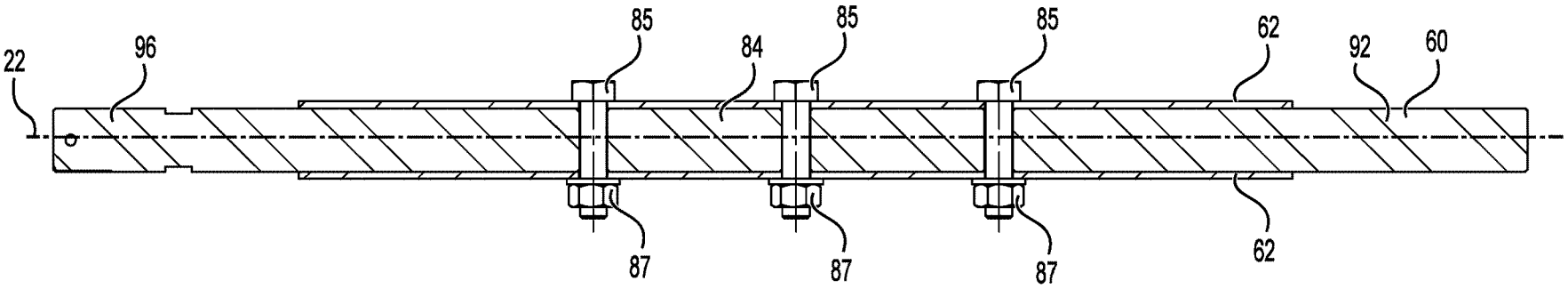
FIG. 15 is a cross-sectional view of part of the lead blade assembly of FIG. 12, taken along line 15-15 in FIG. 14.

The blade assembly 20L has a shaft 60 and two blades 62 connected to the shaft 60 such that the shaft 60 is disposed between the blades 62. As shown in FIG. 13, the blades 62 are plate-like members having a width slightly smaller than a distance between the lateral walls 14 of the frame 12 so as to fit therebetween.

Both blades 62 are identical and therefore the following description of one of the blades 62 is understood to apply to both blades 62. The blade 62 has opposite transversal end portions 64, 66 that extend transversally to the opposite lateral ends 68, 70 of the blade 62. The transversal end portions 64, 66 define respective inner surfaces 67, 69 (FIG. 13) extending generally parallel to one another. As can be seen, the transversal end portion 64 has a length that is greater than a length of the opposite transversal end portion 66. The transversal end portions 64, 66 may thus be referred to as long and short transversal end portions 64, 66 respectively. The blade 62 also has a central transversal portion 72 that is fastened to the shaft 60. The central transversal portion 72, which is disposed between the transversal end portions 64, 66, defines an inner surface 73 that is generally parallel to the inner surfaces 67, 69 of the transversal end portions 64, 66. The blade 62 also has two slanted portions 74, 76, each of which extends between one of the transversal end portions 64, 66 and the central transversal portion 72. The inner and outer surfaces of the slanted portions 74, 76 extend at an angle relative to the inner surfaces 67, 69, 73.

Figure 16:
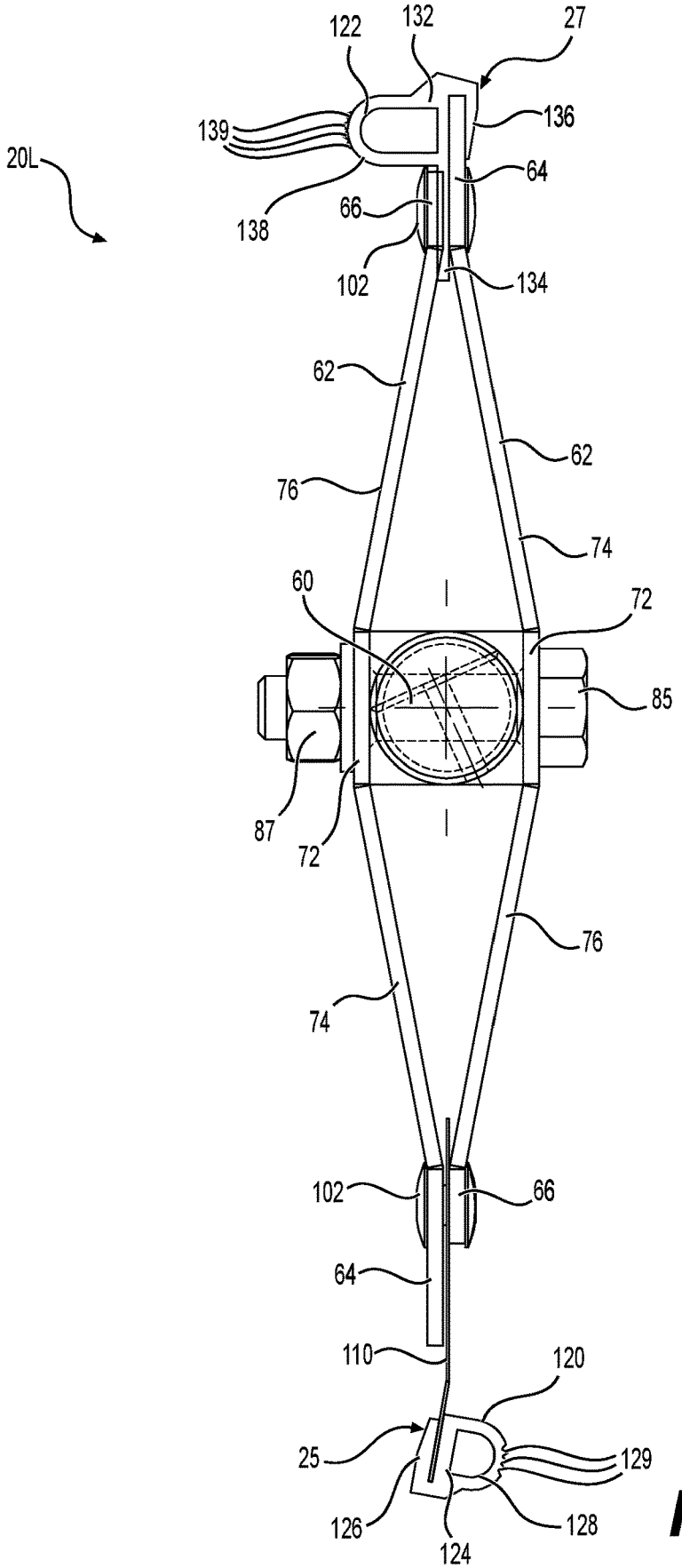
FIG. 16 is a right side elevation view of the lead blade assembly of FIG. 12.

Due to this configuration of the blades 62, as shown in FIG. 16, the spacing between the blades 62 is greatest at the shaft 60 and smallest at the end portions 64, 66 of the blades 62. Notably, in a cross-section of the blade assembly 20 taken along a plane normal to the blade rotation axis 22, the blades 62 form a diamond-like shape. Moreover, as shown in FIG. 16, when the blade assembly 20 is assembled, the long transversal end portion 64 of each blade 62 is aligned with the short transversal end portion 66 of the opposite blade 62 such that one end of each blade 62 extends beyond the corresponding end of the opposite blade 62.

In this embodiment, the blades 62 are made of stainless steel. In particular, the blades 62 are made of SAE 304 stainless steel. It is contemplated that the blades 62 could be made of other materials in other embodiments. Moreover, in this embodiment, the blades 62 have a 2B surface finish. Other surface finishes are contemplated.

The shaft 60 extends laterally and defines the blade rotation axis 22 of the lead blade assembly 20L. In order to allow rotation of the lead blade assembly 20L, the shaft 60 is rotatably supported by the frame 12 via two bearings 80 (see FIGS. 1, 2 and 4) mounted to the opposite lateral walls 14 of the frame 12.

The shaft 60 is designed to have a shape that facilitates correct alignment of the blades 62 relative to the shaft 60. To that end, as shown in FIG. 13, the shaft 60 has a rectangular cuboid portion 82 having a cross-sectional profile that is generally square. In particular, the rectangular cuboid portion 82 of the shaft 60 defines four flat surfaces, including two parallel mounting surfaces 84 that are opposite one another (i.e., facing opposite directions) and to which the blades 62 are fastened. Specifically, the central transversal portions 72 of the blades 62 are mated with respective ones of the mounting surfaces 84 and openings 86 defined by the central transversal portions 72 of the blades 62 are aligned with corresponding openings 90 defined by the rectangular cuboid portion 82 of the shaft 60. The openings 90 extend through both mounting surfaces 84. Bolts 85 are inserted through the openings 86, 90 of the blades 62 and the shaft 60 and received by corresponding nuts 87 that threadedly engage the bolts 85. Washers 89 are inserted between the nuts 87 and the corresponding blade 62.

Furthermore, in order to be rotatably supported by the bearings 80, the shaft 60 has two cylindrical portions 92, 94 that extend on opposite sides of the rectangular cuboid portion 82 and are received by the bearings 80. As such, the cylindrical portions 92, 94 of the shaft 60 are journaled by the frame 12. Furthermore, the shaft 60 has a non-cylindrical portion 96 which extends from the left cylindrical portion 94 to define a left end 95 of the shaft 60. A right end 97 of the shaft 60 is defined by the right cylindrical portion 92. The non-cylindrical portion 96 is referred to as such as it has a cross-sectional profile of a non-circular shape which facilitates the driving engagement of the non-cylindrical portion 96 by the two driving links 50. Notably, each of the driving links 50 has an opening 99 of a matching non-circular shape so as to receive the non-cylindrical portion 96. In this embodiment, the non-circular shape of the cross-sectional profile of the non-cylindrical portion 96 is a semi-circular shape with rounded corners. It is contemplated that the cross-sectional profile of the non-cylindrical portion 96 could have other non-circular shapes in other embodiments.

In other embodiments, the non-cylindrical portion 96 may be omitted (e.g., the shaft 60 could be driven by a key and groove arrangement).

Each of the portions 82, 92, 94, 96 of the shaft 60 thus has a function in the operation of the shaft 60. Notably, the cylindrical portions 92, 94 are engaged by the bearings 80, while the non-cylindrical portion 96 facilitates driving engagement of the shaft 60 with the blade rotation system 30. Moreover, as will be understood, the flat mounting surfaces 84 of the rectangular cuboid portion 82 of the shaft 60 allow the blades 62 to sit squarely on the shaft 60 in a predefined position, namely since the blades 62 have corresponding flat inner surfaces 73 that are mated with the flat mounting surfaces 84. As such, the flat mounting surfaces 84 of the shaft 60 reduce a chance of misaligning the blades 62 on the shaft 60 which might otherwise result in the damper 10 having substantial leaks formed between the blade assemblies 20 in the closed position of the blade assemblies 20. Furthermore, since all the shafts 60 of the blade assemblies 20 have this same configuration (as will be explained below, the shaft 60 of the lead blade assembly 20L is made longer) and all the connecting links 52 connected thereto are identical, the blades 62 of the blade assemblies 20 are generally aligned with one another such the blade assemblies 20 contact one another at the same time when reaching the closed position.

Returning to FIG. 12, the end portions 64, 66 of one of the blades 62 of the blade assembly 20L is fastened to the end portions 64, 66 of the other one of the blades 62 via respective fasteners 102 (e.g., rivets) extending through openings 104 defined by the end portions 64, 66. In particular, the end portion 64 of the first blade 62 is fastened to the end portion 66 of the second blade 62, while the end portion 66 of the first blade 62 is fastened to the end portion 64 of the second blade 62. As mentioned above, the end portions 64, 66 have different lengths, and therefore, as best shown in FIG. 16, the blades 62 are asymmetrical to one another about a plane extending therebetween.

Figure 12:
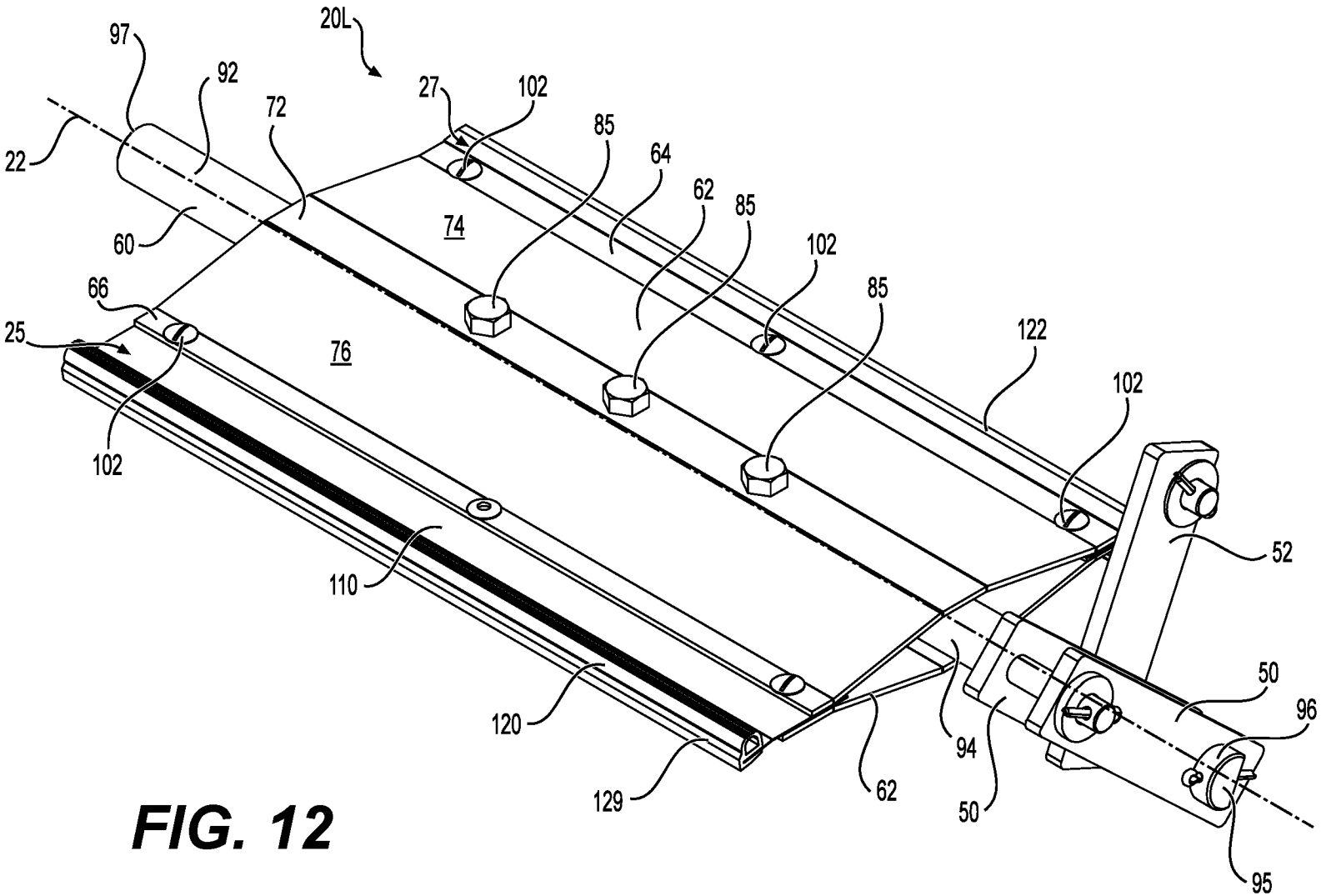
FIG. 12 is a perspective view, taken from a bottom, rear, left side, of a lead blade assembly of the damper of FIG. 1.

In order to further reduce the possibility of gaps between adjacent blade assemblies 20 when in the closed position, the blade assembly 20L also has a blade extension 110 that is disposed at the first end portion 25 of the blade assembly 20L. The blade extension 110 is a generally rectangular member which extends along an entire length of the blades 62 defined between the lateral ends 68, 70. As best shown in FIGS. 12, 13 and 16, the blade extension 110 is held between the blades 62 of the blade assembly 20L and extends therefrom. In particular, the blade extension 110 defines three openings 112 extending through the thickness of the blade extension 110 and which receive respective ones of the fasteners 102 therethrough so that a portion of the blade extension 110 is clamped between the end portions 64, 66 of the opposite blades 62.

The blade extension 110 is configured to elastically deform upon the first end portion 25 of the blade assembly 20 contacting the second end portion 27 of the adjacent blade assembly 20 in the closed position. To that end, in this embodiment, the blade extension 110 is made of a relatively flexible material. For instance, the blade extension 110 is made of a material that has a smaller elastic modulus than the material of the blades 62. More specifically, in this embodiment, the blade extension 110 is made of SAE 301 stainless steel. This type of stainless steel is more pliable than that used for the blades 62 and thus confers more elasticity to the blade extension 110 than that provided to the blades 62.

Due to its elastic deformability, the blade extension 110 can compensate for misalignments between adjacent blade assemblies 20. For instance, if a blade assembly 20 were misaligned such that one side of the first end portion 25 contacts the adjacent blade assembly 20 before the other side of the first end portion 25 while the blade assemblies 20 rotate from the open position to the closed position, this might result in a gap formed between both blade assemblies 20 in the closed position. However, even though the blades 62 of the adjacent blade assemblies 20 might not be in full contact, the blade extension 110 extends further from the blades 62 and is elastically deformed such that the uneven contact between the blades 62 of the adjacent blade assemblies 20 does not result in a gap therebetween.

The blade assembly 20L also includes two seal members 120, 122 provided at the first and second end portions 25, 27 of the blade assembly 20L respectively. As will be described below, the seal members 120, 122 are provided to form seals between the blade assemblies 20 so as to further prevent air flow between the blade assemblies 20 when the blade assemblies 20 are in the closed position. Each of the seal members 120, 122 thus extends along an entire length of the blades 62.

With reference to FIG. 16, the seal member 120 has a body 124 and a clip leg 126 extending from the body 124. A gap is formed between the clip leg 126 and the body 124 of the seal member 120. This gap allows the seal member 120 to be secured to the end of the blade extension 110. Notably, the end of the blade extension 110 is inserted between the body 124 and the clip leg 126, the gap between the body 124 and the clip leg 126 being sized so as to provide a snug fit between the blade extension 110 and the seal member 120. The seal member 120 can be bonded or otherwise fastened to the blade extension 110. The body 124 of the seal member 120 has a rounded contact portion 128 which is configured to contact the second end portion 27 of one of the adjacent blade assemblies 20 when the blade assemblies 20 are in the closed position. In particular, in this embodiment, the seal member 120 has a cross-sectional profile that is generally D-shaped. As can be seen, the rounded contact portion 128 has a plurality of triangular projections or ridges 129 that protrude therefrom. The projections 129 are helpful to improve the seal formed by the sealing member 120 with the adjacent blade assembly 20.

With continued reference to FIG. 16, the seal member 122 has a body 132 and two clip legs 134, 136 extending from the body 132. The clip legs 134, 136 extend generally parallel to one another, with the clip leg 134 being longer than the clip leg 136. A gap is formed between the clip legs 134, 136. This gap allows the seal member 122 to be secured to the second end portion 27 of the blade assembly 20. Notably, the clip leg 124 is retained between the end portions 64, 66 of the opposite blades 62. The end portion 66 of one of the blades 62 is inserted in the gap defined between the clip legs 134, 136. The seal member 122 can be bonded or otherwise fastened to the blades 62. The body 132 of the seal member 122 has a rounded contact portion 138 which is configured to contact the first end portion 25 of one of the adjacent blade assemblies 20 when the blade assemblies 20 are in the closed position. In particular, in this embodiment, the seal member 122 has a cross-sectional profile that is generally P-shaped. As can be seen, the rounded contact portion 138 has a plurality of triangular projections or ridges 139 that protrude therefrom. The projections 139 are helpful to improve the seal formed by the sealing member 122 with the adjacent blade assembly 20.

It is contemplated that the seal members 120, 122 may be shaped differently in other embodiments.

In this embodiment, the seal members 120, 122 are made of silicone. Specifically, since, in some applications of the damper 10, the seal members 120, 122 may be exposed to elevated temperatures, the silicone material of the seal members 120, 122 is resistant to temperatures as high as 500° F. (260° C.). For instance, in this embodiment, the seal members 120, 122 are made of silicone grade SI 5011CL produced by LOCTITE®. Other types of silicone could be used in other embodiments. Furthermore, in some embodiments, the seal members 120, 122 could be made from other materials. For instance, it is contemplated that in some embodiments, the seal members 120, 122 could be made of fiber glass. This may allow the seal members 120, 122 to be exposed to even greater temperatures. Notably, in such embodiments, the fiber glass material of the seal members 120, 122 is resistant to temperatures as high as 932° F. (500° C.).

Figure 7:
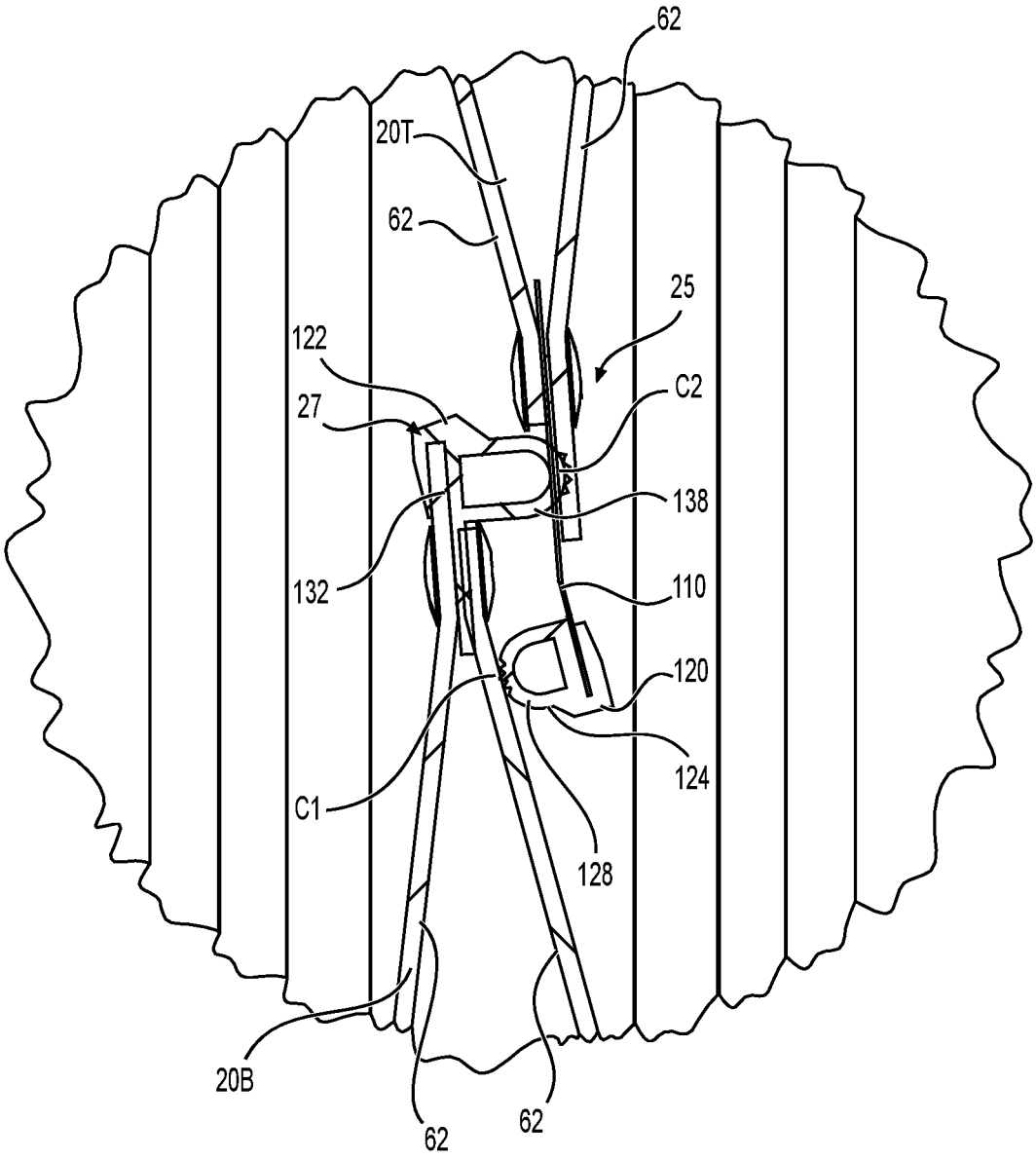
FIG. 7 a close-up view of part of FIG. 6.
Figure 8:
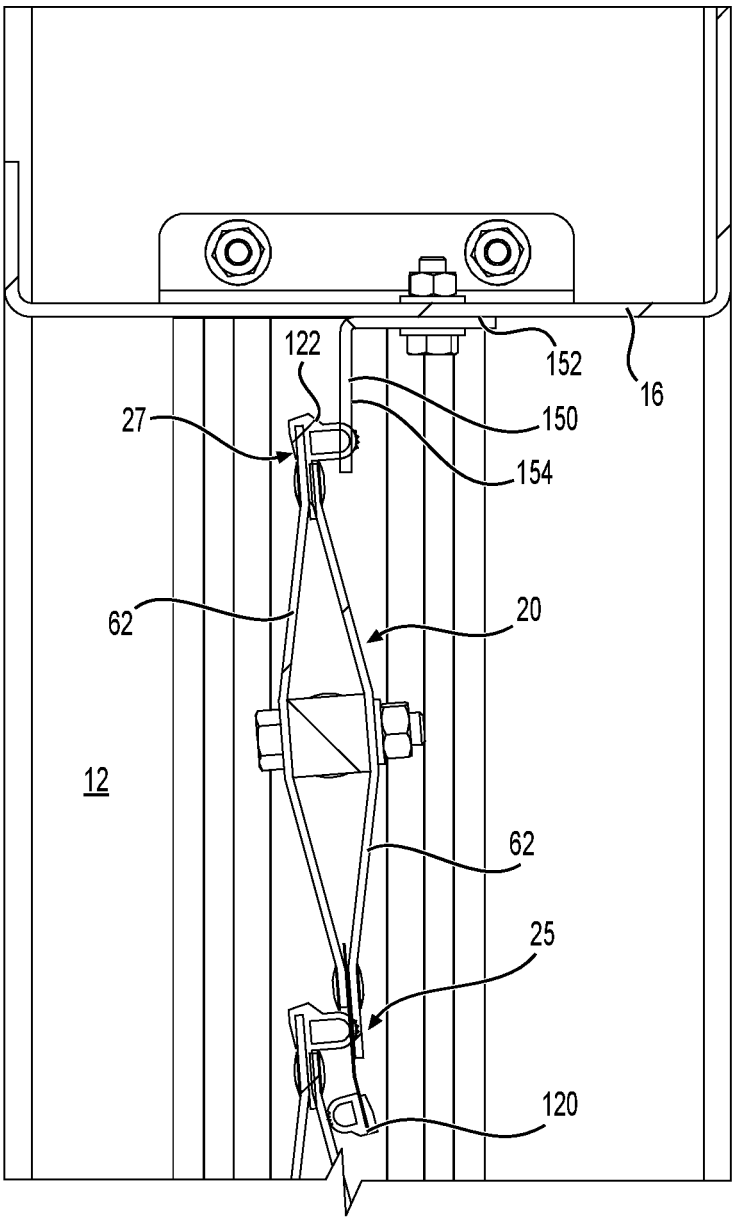
FIG. 8 is a close-up view of another part of FIG. 6, showing a topmost blade assembly of the damper.

The function of the seal members 120, 122 will become more apparent when referring to FIG. 7 which illustrates the interaction between two adjacent blade assemblies 20 when the blade assemblies 20 are in the closed position. For simplicity of this description, the blade assembly 20 that is vertically higher in FIG. 7 will be referred to as the top blade assembly 20T while the other will be referred to as the bottom blade assembly 20B. It is understood that this nomenclature is merely for facilitating the description and not to limit the present technology to this particular orientation of the damper 10. As can be seen, when the blade assemblies 20T, 20B are in the closed position, the seal member 120 at the first end portion 25 of the top blade assembly 20T contacts the second end portion 27 of the bottom blade assembly 20B, and specifically one of its blades 62. The blade extension 110 of the top blade assembly 20T elastically deforms due to the force applied by this contact between the seal member 120 at its end and the bottom blade assembly 20B. The seal member 120 of the top blade assembly 20T thus forms a first seal between the top and bottom blade assembles 20T, 20B at a first contact point C1 between the seal member 120 and the second end portion 27 of the bottom blade assembly 20B. Notably, the seal member 120 of the top blade assembly 20T is disposed at least in part and is compressed between the first end portion 25 of the top blade assembly 20T and the second end portion 27 of the bottom blade assembly 20B. At the same time, when the blade assemblies 20T, 20B are in the closed position, the seal member 122 at the second end portion 27 of the bottom blade assembly 20B contacts the first end portion 25 of the top blade assembly 20T, and specifically the blade extension 110 thereof. As will be explained further below, the blade extension 110 may be omitted in some embodiments, in which case the seal member 122 would form the seal with one of the blades 62 of the top blade assembly 20T. The seal member 122 of the bottom blade assembly 20B thus forms a second seal between the top and bottom blade assembles 20T, 20B at a second contact point C2 between the seal member 122 and the first end portion 25 of the top blade assembly 20T. Notably, the seal member 122 of the bottom blade assembly 20B is disposed at least in part and is compressed between the first end portion 25 of the top blade assembly 20T and the second end portion 27 of the bottom blade assembly 20B. As can be seen, the two contact points C1, C2 are spaced from one another. For instance, the first contact point C1 is further from the blade rotation axis 22 of the top blade assembly 20T than the second contact point C2 (which is closer to the blade rotation axis 22 of the top blade assembly 20T). Likewise, the second contact point C2 is further from the blade rotation axis 22 of the bottom blade assembly 20B than the first contact point C1 (which is closer to the blade rotation axis 22 of the bottom blade assembly 20B). Therefore, together, the seal members 120, 122 of the top and bottom blade assemblies 20T, 20B provide a double seal between the top and bottom blade assembles 20T, 20B. As will be understood, this may further reduce potential leaks between the top and bottom blade assemblies 20T, 20B. Moreover, this can provide a degree of redundancy as even if one of the seal members 120, 122 were to degrade such that the seal formed thereby were no longer as effective, the other seal member 120, 122 still provides a seal between the blade assemblies 20T, 20B.

Figure 17:
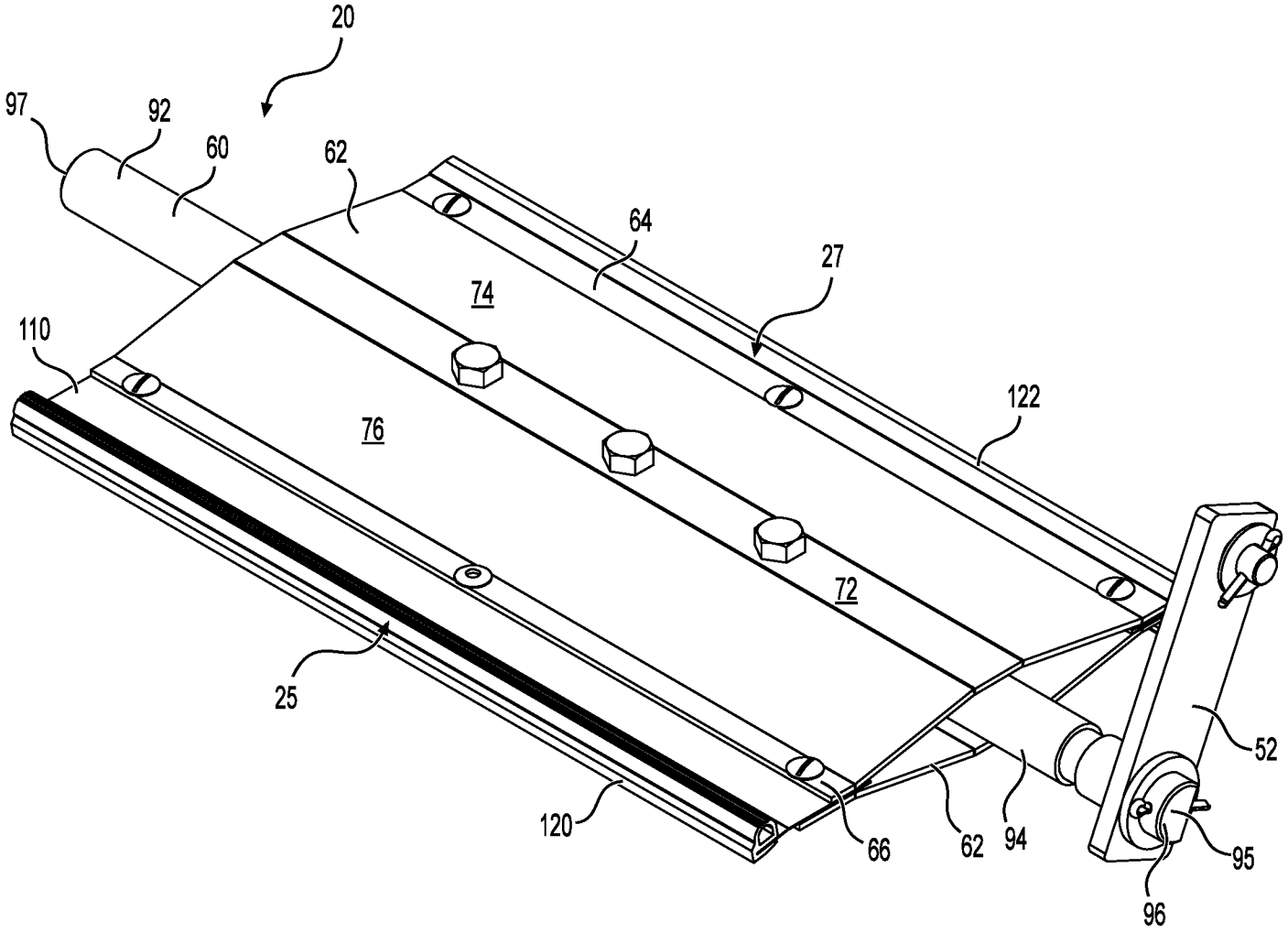
FIG. 17 is a perspective view, taken from a bottom, rear, left side, of another blade assembly of the damper of FIG. 1.

As mentioned briefly above, the lead blade assembly 20L (i.e., the blade assembly 20 that is connected to the linkage assembly 32 to be driven thereby) has some minor differences compared to the other blade assemblies 20. Notably, the shaft 60 of the lead blade assembly 20L extends further (i.e., is longer) than the shafts 60 of the other blade assemblies 20 of the damper 10 so as to allow the shaft 60 of the lead blade assembly 20 to be connected to the driving links 50 of the linkage assembly 32. For instance, another one of the blade assemblies 20 is shown in FIG. 17. The same parts have been designated with the same numerals as for the lead blade assembly 20L as their description can be assumed to be the same unless mentioned otherwise herein. As can be seen, the non-cylindrical portion 196 of the shaft 60 of the blade assembly 20 of FIG. 17 is shorter than that of the lead blade assembly 20L, namely since it does not need to be connected to the driving links 50 of the linkage assembly 32. Instead, the non-cylindrical portion 96 of the shaft 60 is only connected to the link 52.

Figure 18:
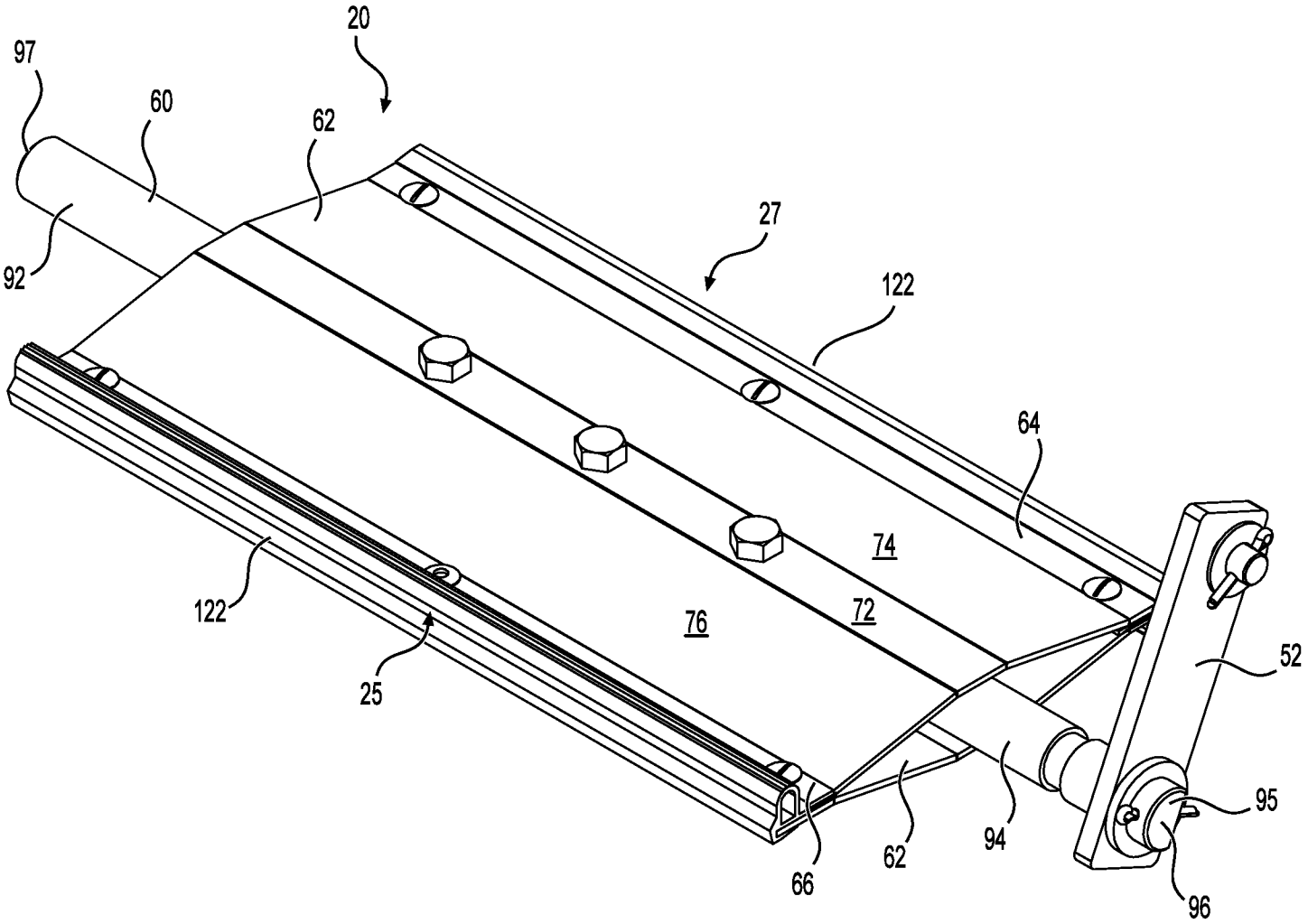
FIG. 18 is a perspective view, taken from a bottom, rear, left side, of the bottommost blade assembly of the damper of FIG. 1.
Figure 19:
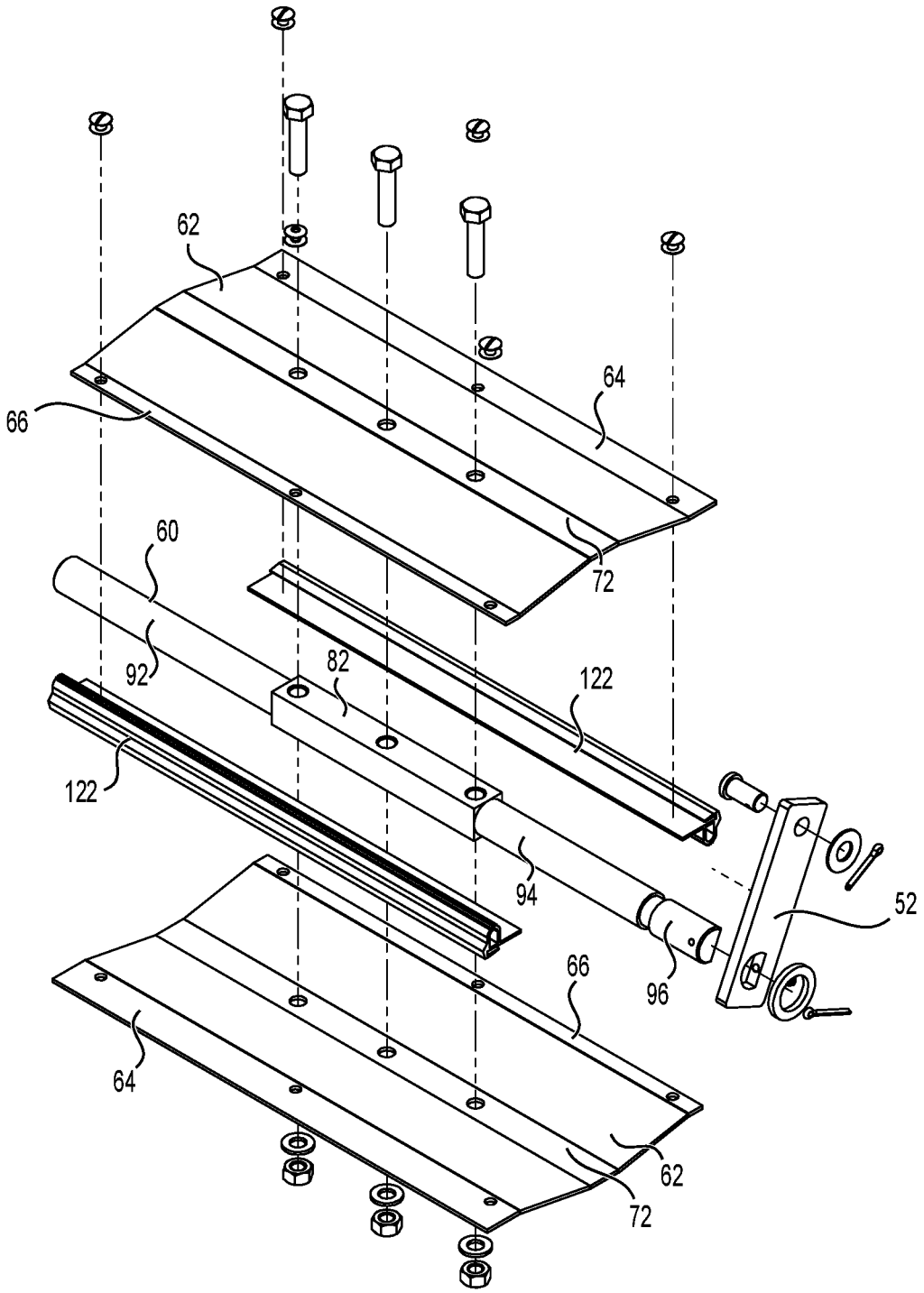
FIG. 19 is an exploded view of the bottommost blade assembly of FIG. 18.
Figure 20:
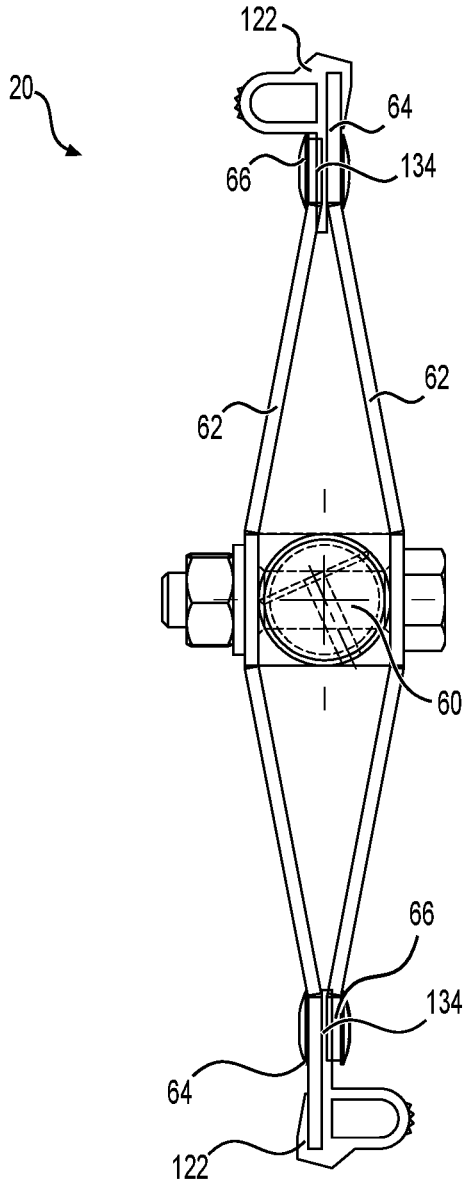
FIG. 20 is a right side elevation view of the bottommost blade assembly of FIG. 18.

With reference to FIGS. 18 to 20, in this embodiment, another one of the blade assemblies 20 of the damper 10 also has some notable differences compared to the other blade assemblies 20. In particular, in this embodiment, the bottommost blade assembly 20, adjacent to the bottom end wall 16 of the frame 16, is configured differently than the lead blade assembly 20L and the other blade assemblies 20. Notably, because the bottommost blade assembly 20 is not disposed above any other blade assembly 20 (i.e., there is no blade assembly 20 disposed below the bottommost blade assembly 20), it is not equipped with the blade extension 110 or with the sealing member 120 which would otherwise be secured to the blade extension 110. Rather, in the bottommost blade assembly 20, as best seen in FIG. 20, both first and second end portions 25, 27 thereof are provided with the sealing member 122 having the P-shaped cross-sectional profile. Both sealing members 122 of the bottommost blade assembly 20 are connected to the blades 62 in the same manner as described above, namely being retained between the end portions 64, 66 of the two blades 62.

Figure 9:
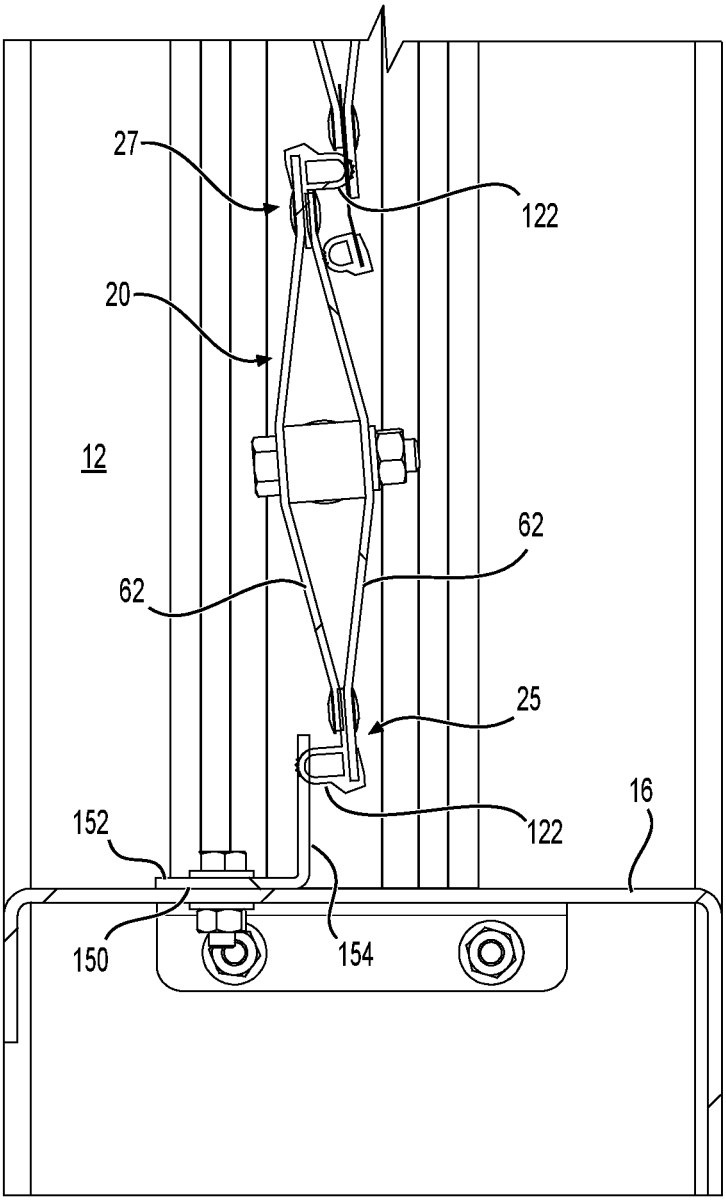
FIG. 9 is a close-up view of another part of FIG. 6, showing a bottommost blade assembly of the damper.
Figure 10:
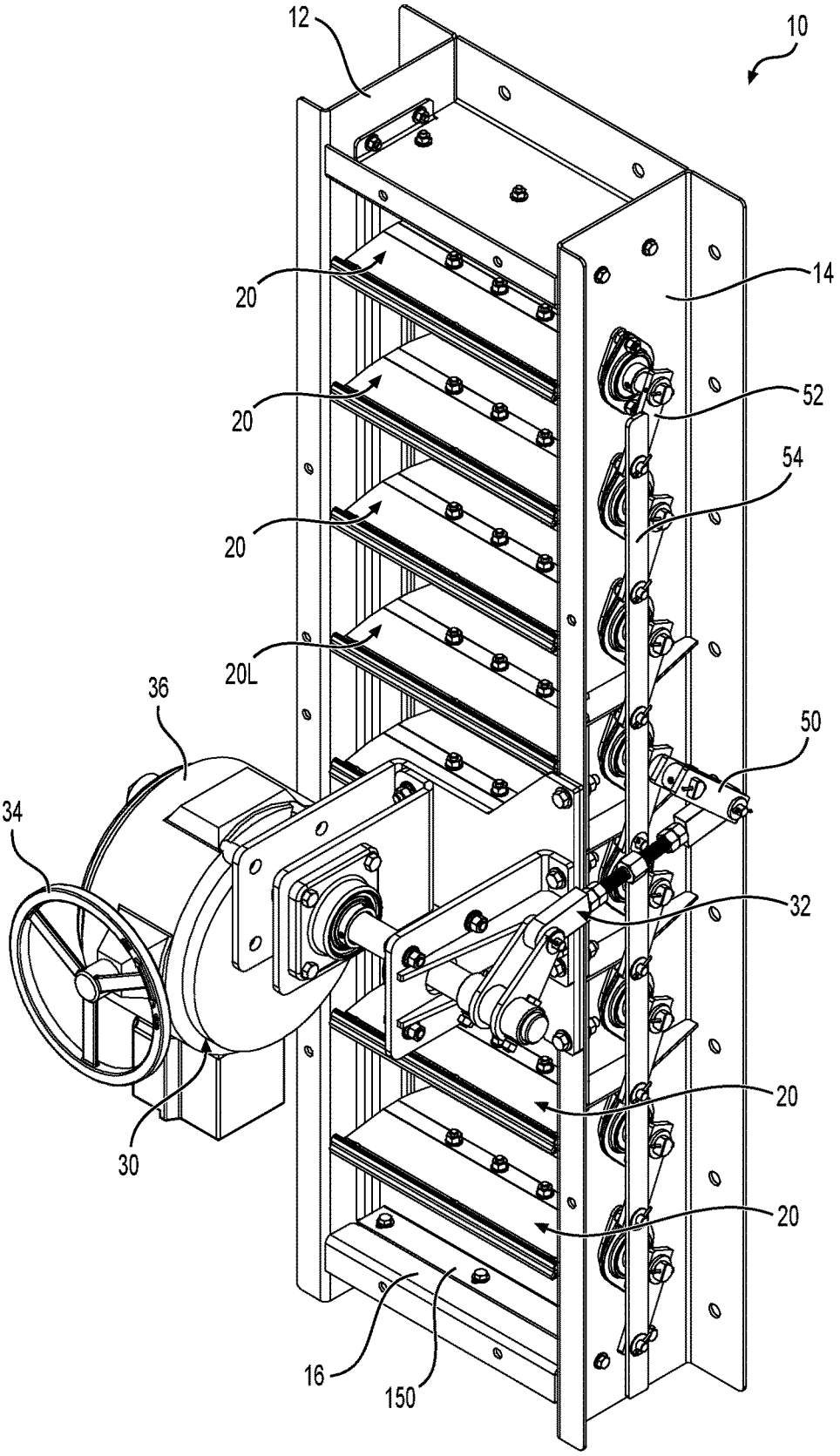
FIG. 10 is a perspective view, taken from a top, front, left, side, of the damper of FIG. 1, with the blade assemblies of the damper being shown in an open position.

As such, as shown in FIG. 9 which illustrates the bottommost blade assembly 20 in the closed position, the damper 10 has a blade supporting member 150 connected to the bottom end wall 16 of the frame 12. The blade supporting member 150 has a generally L-shaped cross-sectional profile. Notably, the blade supporting member 150 has a parallel portion 152 that extends parallel to the bottom end wall 16, and a transversal portion 154 that extends transversally to the bottom end wall 16. The parallel portion 152 is fastened to the bottom end wall 16. From the bottom end wall 16, the transversal portion 56 extends upwardly towards the top end wall 16 of the frame 12. The blade supporting member 150 extends along a majority or an entirety of the distance between the lateral walls 14 of the frame 12. In this embodiment, the blade supporting member 150 is made of stainless steel such as SAE 304 stainless steel. As can be seen, in the closed position of the bottommost blade assembly 20, the seal member 122 disposed at the first end portion 25 of the blade assembly 20 contacts the blade supporting member 150. The seal member 122 thus forms a seal between the first end portion 25 of the blade assembly 20 and the blade supporting member 150.

Figure 21:
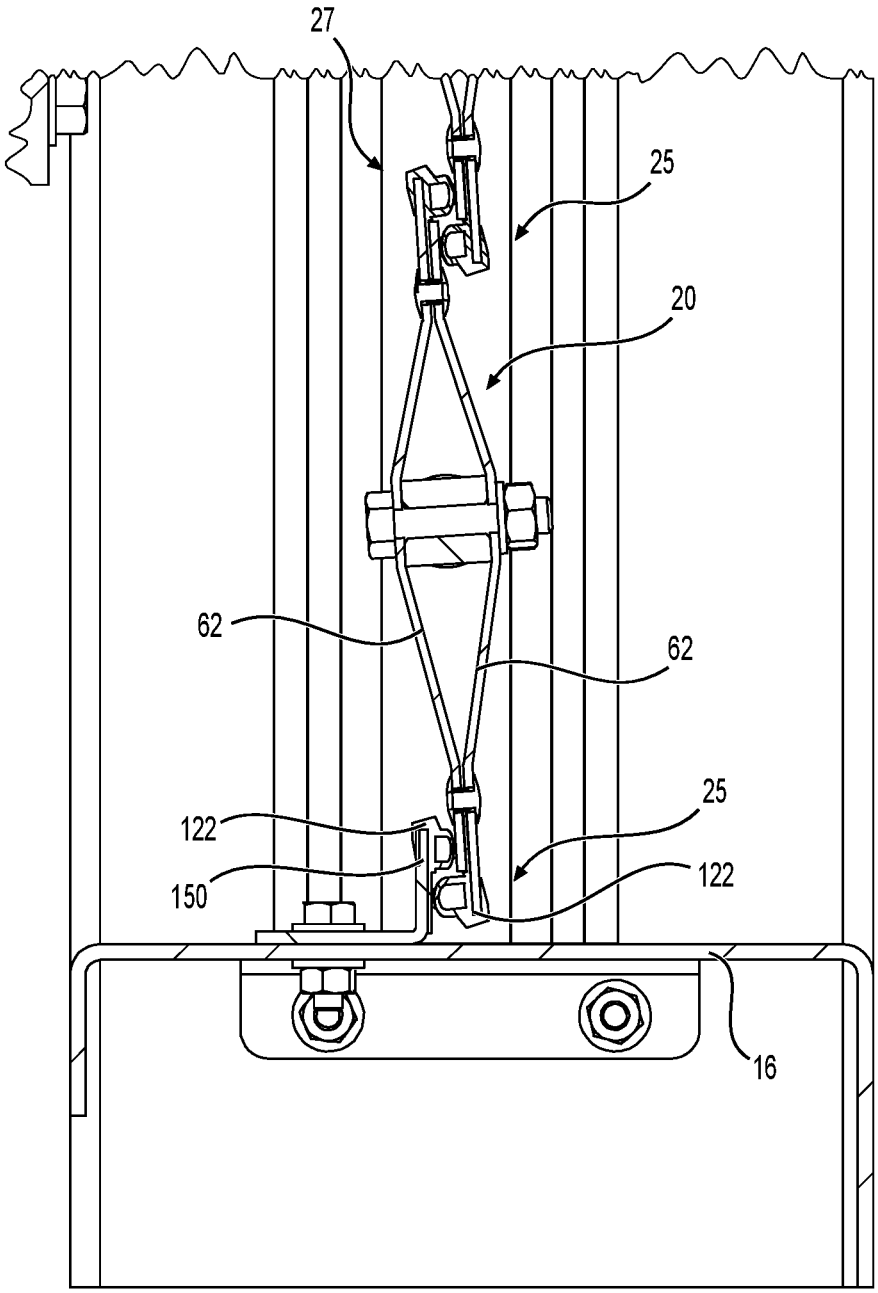
FIG. 21 is a cross-sectional view of the damper showing the bottommost blade assembly of the damper in the closed position and a corresponding blade supporting member of the damper according to another embodiment.

Furthermore, with reference to FIG. 21, in some embodiments, the blade supporting member 150 could also be provided with a corresponding seal member 122. Notably, as shown in FIG. 21, a seal member 122 constructed as described above with respect to the blade assemblies 20 is connected to the blade supporting member 150. As such, the when the bottommost blade assembly 20 is in the closed position, a double seal is formed between the blade supporting member 150 and the bottommost blade assembly 20 (similarly to the double seals formed between the adjacent blade assemblies 20) as the seal member 122 connected to the blade supporting member 150 abuts the first end portion 25 of the bottommost blade assembly 20 while the seal member 122 of the bottommost blade assembly 20 abuts the blade supporting member 150. The seals formed by each of the two seal members 122 are thus distance from one another, providing a double seal that may further reduce potential leaks between the blade supporting member 150 and the bottommost blade assembly 20 and can provide a degree of redundancy as discussed above with respect to the blade assemblies 20.

Figure 22:
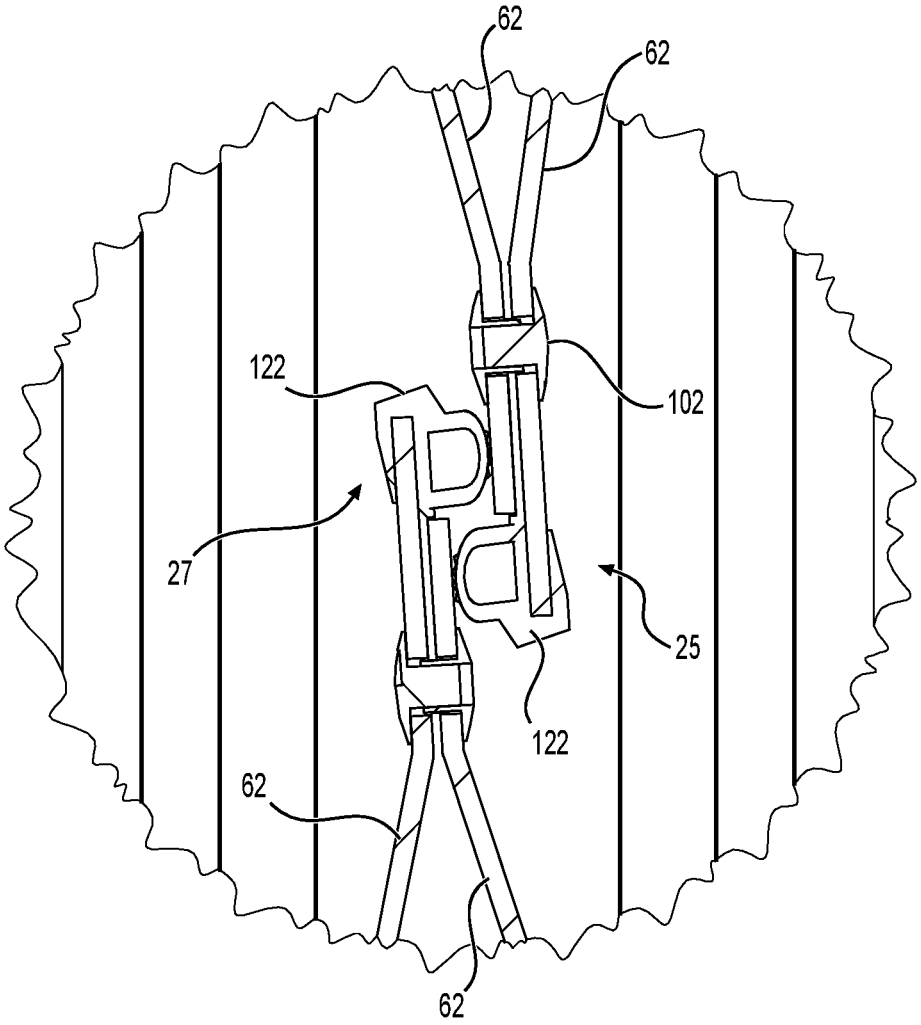
FIG. 22 is a cross-sectional view of the damper showing two adjacent ones of the blade assemblies according to another embodiment.

Furthermore, in some embodiments, the blade assemblies 20 other than the bottommost blade assembly 20 may also not be provided with the blade extension 110. Notably, with reference to FIG. 22, both the first and second end portions 25, 27 of each blade assembly 20 could be provided with the sealing member 122 having the P-shaped cross-sectional profile. In such embodiments, both sealing members 122 of the blade assembly 20 are connected to the blades 62 in the same manner as described above, namely being retained between the end portions 64, 66 of the two blades 62. For instance, in such embodiments, all blade assemblies 20 could be configured such as the blade assembly 20 illustrated in FIG. 20.

Figure 23:
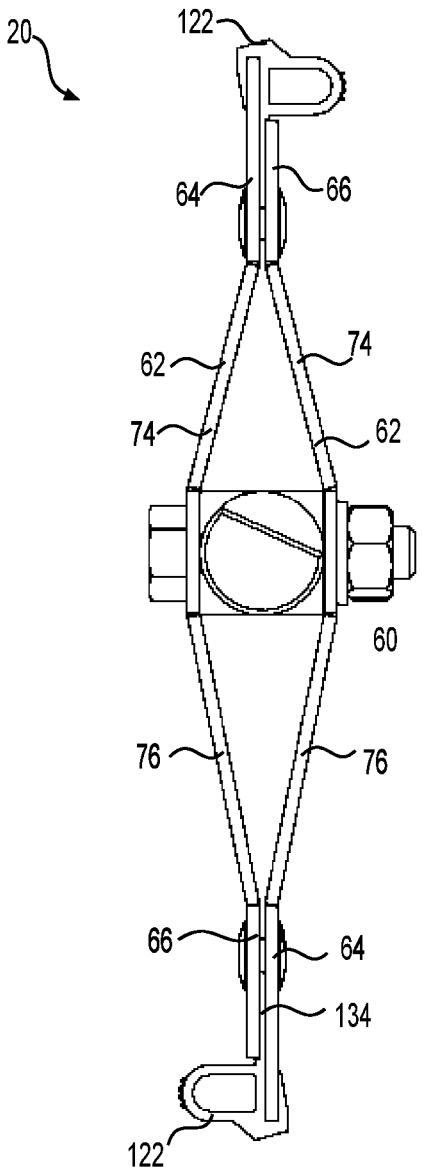
FIG. 23 is a left side elevation view of one of the blade assemblies according to another embodiment.

In yet other embodiments, the blade assemblies 20 could still be elastically deformable to some extent without being provided with the blade extension 110. For instance, as shown in FIG. 23, in some embodiments, the long and short transversal end portions 64, 66 of the blades 62 of each blade assembly 20 could be made longer relative to the slanted portions 74, 76. The additional length of the transversal end portions 64, 66 could allow some elastic deformation of the ends of the blades 62 when the end portions 25, 27 of adjacent blade assemblies 20 contact one another.

As will be appreciated, the topmost blade assembly 20, adjacent to the top end wall 16 of the frame 12, is not disposed below any other blade assembly 20 (i.e., there is no blade assembly 20 disposed above the topmost blade assembly 20). Therefore, with reference to FIG. 8 which illustrates the topmost blade assembly 20 in the closed position, the damper 10 includes another blade supporting structure 150 fastened to the top end wall 16. In this case, the transversal portion 154 of the blade supporting structure 150 extends downwardly towards the bottom end wall 16. In the closed position, the sealing member 122 contacts the transversal portion 154 of the blade supporting structure 150 to form a seal therebetween. Similarly to the blade supporting member 150 connected to bottom end wall 16 illustrated in FIG. 21, in some embodiments, the blade supporting member 150 connected to the top end wall 16 could be provided with a seal member 122 to form a double seal with the topmost blade assembly 20 in the closed position thereof.

The above-described configuration of the damper 10 provides a construction that results in fewer misalignments between the components of the damper 10 such that the damper 10 is more efficient and is subject to fewer air flow leaks in the closed position of its blade assemblies in comparison to conventional dampers. Moreover, a more effective seal is provided between the adjacent blade assemblies 20.

Modifications and improvements to the above-described embodiments of the present technology may become apparent to those skilled in the art. The foregoing description is intended to be exemplary rather than limiting. The scope of the present technology is therefore intended to be limited solely by the scope of the appended claims.

What is claimed is:

1. A damper comprising:

a frame;

at least one first blade assembly and at least one second blade assembly disposed next to one another and rotatably supported by the frame, the at least one first blade assembly and the at least one second blade assembly being rotatable together about respective blade rotation axes between an open position and a closed position, each of the at least one first blade assembly and each of the at least one second blade assembly having a first end portion and a second end portion, in response to the at least one first blade assembly and the at least one second blade assembly being in the open position:

the at least one first blade assembly and the at least one second blade assembly being spaced apart to permit gas flow through the damper, the first end portion of the at least one first blade assembly and the first end portion of the at least one second blade assembly are on a first side of the blade rotation axes, and the second end portion of the at least one first blade assembly and the second end portion of the at least one second blade assembly are on a second side of the blade rotation axes, in response to the at least one first blade assembly and the at least one second blade assembly being in the closed position, the first end portion of the at least one first blade assembly being in contact with the second end portion of the at least one second blade assembly to restrict gas flow through the damper, each of the at least one first blade assembly and each of the at least one second blade assembly comprising:

a shaft rotatably supported by the frame, the shaft defining the blade rotation axis of the blade assembly;

a first blade connected to the shaft; and a second blade connected to the shaft, the shaft being disposed between the first and second blades, the first and second blades being connected to one another at the first and second end portions of the blade;

the at least one first blade assembly further comprising:

a first seal member disposed at the first end portion of the at least one first blade assembly; and a flexible blade extension disposed at the first end portion of the at least one first blade assembly, the flexible blade extension being held between the first and second blades of the at least one first blade assembly and extending from the first and second blades, the first seal member being connected to the flexible blade extension, the flexible blade extension connecting the first seal member to the first and second blades of the at least one first blade assembly;

the at least one second blade assembly further comprising a second seal member disposed at the second end portion of the at least one second blade assembly, the second seal member being connected to the first and second blades of the at least one second blade assembly, in the closed position of the at least one first blade assembly and the at least one second blade assembly:

the first seal member abutting the second end portion of the at least one second blade assembly at a first contact point to form a first seal between the at least one first blade assembly and the at least one second blade assembly, the flexible blade extension being configured to flex in response to the second end portion of the at least one second blade assembly applying a transverse load to the flexible blade extension as the first seal member contacts the second end portion of the at least one second blade assembly, the second seal member of the at least one second blade assembly abutting the first end portion of the at least one first blade assembly at a second contact point to form a second seal between the at least one first blade assembly and the at least one second blade assembly, the first contact point being further from the blade rotation axis of the at least one first blade assembly than the second contact point, the second contact point being further from the blade rotation axis of the at least one second blade assembly than the first contact point.

2. The damper of claim 1, wherein:

the second seal member is held between and connected to the first and second blades of the at least one second blade assembly.

3. The damper of claim 1, wherein the first and second seal members are made of one of silicone and fiber glass.

4. The damper of claim 1, wherein:

each of the first and second seal members has a generally P-shaped or D-shaped cross-sectional profile including a rounded contact portion; and in the closed position of the at least one first blade assembly and the at least one second blade assembly:

the rounded contact portion of the first seal member of the at least one first blade assembly abuts the second end portion of the at least one second blade assembly; and the rounded contact portion of the second seal member of the at least one second blade assembly abuts the first end portion of the at least one first blade assembly.

5. The damper of claim 4, wherein the rounded contact portion of each of the first and second seal members comprises a plurality of projections protruding therefrom.

6. The damper of claim 1, wherein, for each of the at least one first blade assembly and each of the at least one second blade assembly:

the shaft comprises a first flat surface and a second flat surface opposite the first flat surface, the second flat surface extending parallel to the first flat surface;

the first blade is fastened to the first flat surface of the shaft; and the second blade is fastened to the second flat surface of the shaft.

7. The damper of claim 6, wherein, for each of the at least one first blade assembly and each of the at least one second blade assembly, the shaft comprises a generally rectangular cuboid portion having a cross-sectional profile that is generally square, the rectangular cuboid portion defining the first and second flat surfaces.

8. The damper of claim 7, wherein, for each of the at least one first blade assembly and each of the at least one second blade assembly, the shaft further comprises a first cylindrical portion and a second cylindrical portion, the first and second cylindrical portions extending on opposite sides of the rectangular cuboid portion of the shaft.

9. The damper of claim 8, further comprising a blade rotation system for rotating each of the at least one first blade assembly and each of the at least one second blade assembly between the open and closed positions, wherein for each of the at least one first blade assembly and each of the at least one second blade assembly, the shaft further comprises a non-cylindrical portion defining an end of the shaft, the non-cylindrical portion of the shaft being engaged by the blade rotation system to drive rotation of the shaft.

10. The damper of claim 8, wherein, for each of the at least one first blade assembly and each of the at least one second blade assembly, the first and second cylindrical portions of the shaft are journaled by the frame.

11. The damper of claim 1, wherein, for each of the at least one first blade assembly and each of the at least one second blade assembly:

the first blade has a first end and a second end;

the second blade has a first end and a second end; and a spacing between the first and second blades is greatest at the shaft and smallest at the first and second ends of the first and second blades.

12. The damper of claim 1, wherein, for the at least one first blade assembly:

the first and second blades are made of a first material;

the flexible blade extension is made of a second material; and the second material has a smaller elastic modulus than the first material.

13. The damper of claim 1, wherein:

the at least one first blade assembly has a first end provided at the first end portion and a second end provided at the second end portion; and the first seal member is disposed at the first end of the at least one first blade assembly, the first seal member being connected to an end of the flexible blade extension of the at least one first blade assembly.

14. The damper of claim 1, further comprising a blade rotation system for rotating each of the at least one first blade assembly and each of the at least one second blade assembly between the open and closed positions, the blade rotation system comprising:

a linkage assembly including a plurality of shaft links drivingly connected to the shaft of the at least one first blade assembly and the at least one second blade assembly; and an actuator connected to the linkage assembly, the actuator being operable to move the linkage assembly to cause the at least one first blade assembly and the at least one second blade assembly to rotate together from the open position to the closed position and vice-versa.

15. The damper of claim 1, wherein the at least one second blade assembly further comprises:

a flexible blade extension disposed at the first end portion of the at least one second blade assembly, the flexible blade extension of the at least one second blade assembly being held between the first and second blades thereof and extending from the first and second blades, the flexible blade extension of the at least one second blade assembly being configured to flex in response to a transvers load being applied to the flexible blade extension upon the first end portion of the at least one second blade assembly contacting a corresponding structure in response to the at least one first blade assembly and the at least one second blade assembly being in the closed position.

16. The damper of claim 1, wherein:

the at least one first blade assembly includes a plurality of first blade assemblies;

the at least one second blade assembly includes a plurality of second blade assemblies; and the first blade assemblies and the second blade assemblies are arranged alternatingly such that each first blade assembly of the plurality of first blade assemblies is disposed next to at least one of the second blade assemblies.

17. The damper of claim 1, wherein:

the frame comprises two opposite lateral walls and two opposite end walls;

the shafts of the at least one first blade assembly and the at least one second blade assembly are rotatably supported by the lateral walls of the frame; and the damper further comprises:

a blade supporting member connected to a given one of the end walls and extending from the given one of the end walls towards the opposite end wall of the frame; and a third blade assembly disposed between one of the at least one second blade assembly and the given one of the end walls of the frames, the third blade assembly being rotatably supported by the frame such that the third blade assembly is rotatable about a corresponding blade rotation axis between the open position and the closed position, the at least one first blade assembly, the at least one second blade assembly and the third blade assembly being rotatable together about the corresponding blade rotation axes between the open position and the closed position, the third blade assembly having a first end portion and a second end portion;

in response to the at least one first blade assembly, the at least one second blade assembly and the third blade assembly being in the open position:

the at least one first blade assembly, the at least one second blade assembly and the third blade assembly being spaced apart to permit gas flow through the damper, the first end portion of the at least one first blade assembly, the first end portion of the at least one second blade assembly and the first end portion of the third blade assembly being on a first side of the blade rotation axes, and the second end portion of the at least one first blade assembly, the second end portion of the at least one second blade assembly and the second end portion of the third blade assembly being on a second side of the blade rotation axes, in response to the at least one first blade assembly, the at least one second blade assembly and the third blade assembly being in the closed position to restrict gas flow through the damper:

the first end portion of the at least one first blade assembly being in contact with the second end portion of the at least one second blade assembly;

the first end portion of the one of the at least one second blade assembly being in contact with the second end portion of the third blade assembly; and the first end portion of the third blade assembly being in contact with the blade supporting member.

18. A damper comprising:

a frame;

at least one first blade assembly and at least one second blade assembly disposed next to one another and rotatably supported by the frame, the at least one first blade assembly and the at least one second blade assembly being rotatable together about respective blade rotation axes between an open position and a closed position, each of the at least one first blade assembly and each of the at least one second blade assembly having:

a first end portion and a second end portion;

a first end provided at the first end portion; and a second end provided at the second end portion, in response to the at least one first blade assembly and the at least one second blade assembly being in the open position:

the at least one first blade assembly and the at least one second blade assembly being spaced apart to permit gas flow through the damper, the first end portion of the at least one first blade assembly and the first end portion of the at least one second blade assembly are on a first side of the blade rotation axes, and the second end portion of the at least one first blade assembly and the second end portion of the at least one second blade assembly are on a second side of the blade rotation axes, the at least one first blade assembly comprising:

a shaft rotatably supported by the frame, the shaft defining the blade rotation axis of the at least one first blade assembly;

a first blade connected to the shaft;

a second blade connected to the shaft, the shaft being disposed between the first and second blades, the first and second blades being connected to one another; and a flexible blade extension disposed at the first end portion of the at least one first blade assembly, the flexible blade extension being held between the first and second blades and extending from the first and second blades, the flexible blade extension being configured to flex in response to the a transverse load being applied to the flexible blade extension upon the first end portion contacting the second end portion of the at least one second blade assembly in response to the at least one first blade assembly and the at least one second blade assembly being in the closed position; and a first seal member disposed at the first end of the at least one first blade assembly, the first seal member of the at least one first blade assembly being connected to an end of the flexible blade extension of the at least one first blade assembly, the flexible blade extension of the at least one first blade assembly connecting the first seal member of the at least one first blade assembly to the first and second blades of the at least one first blade assembly;

the at least one second blade assembly comprising:

a shaft rotatably supported by the frame, the shaft of the at least one second blade assembly defining the blade rotation axis of the at least one second blade assembly;

a first blade connected to the shaft of the at least one second blade assembly;

a second blade connected to the shaft of the at least one second blade assembly, the shaft of the at least one second blade assembly being disposed between the first and second blades of the at least one second blade assembly, the first and second blades of the at least one second blade assembly being connected to one another; and a second seal member disposed at the second end of the at least one second blade assembly, each of the first and second seal members of the least one first blade assembly and the at least one second blade assembly has a rounded contact portion, in response to the at least one first blade assembly and the at least one second blade assembly being in the closed position:

the first end portion of the at least one first blade assembly is in contact with the second end portion of the at least one second blade assembly to restrict gas flow through the damper;

the first seal member of the at least one first blade assembly abuts the second end portion of the at least one second blade assembly at a first contact point to form a seal between the at least one first blade assembly and the at least one second blade assembly at the first contact point;

the second seal member of the at least one second blade assembly abuts the first end portion of the at least one first blade assembly at a second contact point to form an other seal between the at least one first blade assembly and the at least one second blade assembly at the second contact point;

the rounded contact portion of the seal member of the at least one first blade assembly abuts the second end portion of the at least one second blade assembly; and the rounded contact portion of the seal member of the at least one second blade assembly abuts the first end portion of the at least one first blade assembly.

19. The damper of claim 18, wherein, for each of the at least one first blade assembly and the at least one second blade assembly:

the first blade has a first end and a second end;

the second blade has a first end and a second end; and a spacing between the first and second blades is greatest at the shaft and smallest at the first and second ends of the first and second blades.

20. The damper of claim 18, wherein, for the at least one first blade assembly:

the first and second blades are made of a first material;

the flexible blade extension is made of a second material; and the second material has a smaller elastic modulus than the first material.

21. The damper of claim 18, wherein at least one of the seal members of the least one first blade assembly and the at least one second blade assembly has a generally D-shaped cross-sectional profile or a generally P-shaped cross-sectional profile.

22. The damper of claim 18, wherein the rounded contact portion of each of the seal members of the at least one first blade assembly and the at least one second blade assembly comprises a plurality of projections protruding therefrom.

23. The damper of claim 18, further comprising a blade rotation system for rotating each of the at least one first blade assembly and each of the at least one second blade assembly between the open and closed positions, the blade rotation system comprising:

a linkage assembly including a plurality of shaft links drivingly connected to the shaft of the at least one first blade assembly and the at least one second blade assembly; and an actuator connected to the linkage assembly, the actuator being operable to move the linkage assembly to cause the at least one first blade assembly and the at least one second blade assembly to rotate together from the open position to the closed position and vice-versa.

24. The damper of claim 18, wherein:

the frame comprises two opposite lateral walls and two opposite end walls;

the shafts of the at least one first blade assembly and the at least one second blade assembly are rotatably supported by the lateral walls of the frame;

the damper further comprises:

a blade supporting member connected to a given one of the end walls and extending from the given one of the end walls towards the opposite end wall of the frame; and a third blade assembly disposed between one of the at least one second blade assembly and the given one of the end walls of the frames, the third blade assembly being rotatably supported by the frame such that the third blade assembly is rotatable about a corresponding blade rotation axis between the open position and the closed position, the at least one first blade assembly, the at least one second blade assembly and the third blade assembly being rotatable together about the corresponding blade rotation axes between the open position and the closed position, the third blade assembly having a first end portion and a second end portion;

in response to the at least one first blade assembly, the at least one second blade assembly and the third blade assembly being in the open position:

the at least one first blade assembly, the at least one second blade assembly and the third blade assembly being spaced apart to permit gas flow through the damper, the first end portion of the at least one first blade assembly, the first end portion of the at least one second blade assembly and the first end portion of the third blade assembly being on a first side of the blade rotation axes, and the second end portion of the at least one first blade assembly, the second end portion of the at least one second blade assembly and the second end portion of the third blade assembly being on a second side of the blade rotation axes, in response to the at least one first blade assembly, the at least one second blade assembly and the third blade assembly being in the closed position to restrict gas flow through the damper:

the first end portion of the at least one first blade assembly is in contact with the second end portion of the at least one second blade assembly;

the first end portion of the one of the at least one second blade assembly is in contact with the second end portion of the third blade assembly; and the first end portion of the third blade assembly is in contact with the blade supporting member.

* * * * *